US005971307A

United States Patent [19]

Davenport

[11] Patent Number: 5,971,307

[45] Date of Patent: Oct. 26, 1999

[54] ROTARY GRINDER

[76] Inventor: Ricky W. Davenport, P.O. Box 52154, Lafayette, La. 70505-2154

[21] Appl. No.: 09/023,051

[22] Filed: Feb. 13, 1998

[51] Int. Cl.[6] ..... B02C 7/14

[52] U.S. Cl. ..... 241/259.1; 241/261.3; 241/298

[58] Field of Search ..... 241/261.2, 261.3, 241/296, 297, 298, 259.1, 259.2, 259.3

[56] References Cited

U.S. PATENT DOCUMENTS

| | | | |
|---|---|---|---|
| 3,701,488 | 10/1972 | Fisher | 241/259.1 |
| 4,083,503 | 4/1978 | Langdon | 241/259.1 |
| 4,725,336 | 2/1988 | Fisher | 241/244 |
| 5,129,469 | 7/1992 | Jackson . | |
| 5,495,986 | 3/1996 | Davenport . | |
| 5,586,729 | 12/1996 | Davenport . | |

*Primary Examiner*—Mark Rosenbaum
*Attorney, Agent, or Firm*—Robert N. Montgomery

[57] ABSTRACT

An in-line grinder has been developed which can be configured to perform in a variety of applications through the use of an adjustable rotor/stator assembly, removable shear bar, and a variety of interchangeable stator-rotor configurations. A unique drive system utilizing a mechanical seal cartridge provides maximum sealing with a minimum of shaft deflection and run-out thereby improving performance. These improvements collectively allow the grinder to be configured for optimum sizing of solids to a predetermined particle size for a broad range of materials. It has been demonstrated that a class of in-line grinders such as that described herein is applicable for sizing drill cuttings for injection into a subsurface formation by way of an annular space formed in a wellbore. The cuttings are removed from the drilling fluid, conveyed to a shearing and grinding system that converts the cuttings into a viscous slurry with the addition of water and viscosity enhancing polymers. The system in its simplest form comprises a slurry tank, a pump, and the instant in-line grinder. The pump circulates the mixture of cuttings and water (sea water) between the slurry tank and the in-line grinder. The ground mixture leaving the in-line grinder is then routed to an injection pump for high pressure injection into the formation.

23 Claims, 19 Drawing Sheets

ROTARY GRINDER

BACKGROUND OF THE INVENTION

1. Field of the Invention

The present invention relates to in-line grinding or milling apparatus in general which size and disperse solids contained in a liquid slurry as they are pumped through it and more particularly to machines with adjustable rotors having a number of stator-rotor combinations interchangeably mountable in the machine to accomplish a wide variety of size reduction needs. The present invention also pertains to the use of such in-line grinding apparatus in drill cuttings disposal systems wherein the cuttings are treated and refined to form a slurry to be pumped into an earth formation through a well bore.

2. General Background

It is well known within the art that a stator-rotor assembly composed of intermeshing teeth or shear blocks may be use in the sizing of both flexible and friable solids. However, heretofore, fine grinding of such solids produced by such methods have been done by different machines, i.e. ball, or roller mills and fine shredders and the like.

An apparatus for grinding solids as they are pumped through the machine has been disclosed in U.S. Pat. Nos. 5,495,986 and 5,586,729. The apparatus disclosed the concept of utilizing an adjustable rotor in combination with intermeshing teeth or shear blocks to accomplish the size reduction of solids in a liquid slurry. An arrangement of the intermeshing teeth further discloses a tooth arrangement which allows the gap between the stator and rotor to be set for any desired particle size. However, the apparatus does not teach a structure for performing such adjustment nor does it teach a method for interchangeably adapting non-intermeshing rotor and stator elements.

It has now become evident that a need exists for fine grinding solids entrained in a slurry to micron size. Ideally such fine grinding should be accomplished with the same machine configured to receive interchangeable stator-rotor assemblies capable of shearing and or fine grinding particles to micron size. For example, the disposal of drill cuttings from drilling various types of wells has become an increasingly difficult problem due to restrictions imposed by various governmental authorities and the desire to minimize environmental damage. These problems are aggravated, or at least amplified, in certain well drilling operations, particularly in offshore drilling operations, wherein the disposal of drill cuttings normally requires transport of the cuttings to a suitable landfill or shore-based processing system.

One solution to drill cuttings disposal has been to separate the drill cuttings from the drilling fluid and reclaim coarse cuttings for use as construction grade gravel. Finer particles of material are slurried and injected into an earth formation through a disposal well. In many instances, however, disposal of all of the drill cuttings is not as conveniently handled. This is especially evident in offshore well drilling operations where the separated cuttings are not suitable for reuse, reclamation or other disposal processes. The cost of managing drill cuttings has increased dramatically as the offshore platforms migrated into deeper waters which further increases the distance to land-based disposal operations.

U.S. Pat. No. 5,129,469 illustrates a method and system for processing drill cuttings whereby drill cuttings are reduced in particle size by using a centrifugal pump as the grinding means of size reduction. After size reduction, the drill cuttings slurry is injected back into the formation through the well bore. It has been found in practice that the centrifugal pump grinding means contained in the above referenced patent has no ability to produce a consistent particle size. As a result, the system operates best when used in conjunction with a shaker screen to separate oversized solids leaving the centrifugal pump grinding means. Sized solids falling through the screen are suitable for injection, whereas rejects from the screen are recirculated repeatedly through the pump grinding means until they are sufficiently small to pass through the shale shaker screen. It is therefore evident that a more efficient method and apparatus is needed to provide a consistent particle size reduction

SUMMARY OF THE INVENTION

The present invention has been developed with a view toward providing an improved apparatus and method for interchangeably adapting an in-line disk attrition mill, having variable displacement, for use as a rotary shear and or fine particle grinder. The adaptation includes the addition of a fine grind ring surrounding an intermeshing stator-rotor assembly, thereby having the ability to yield an even finer particle size. Further adaptation includes the use of a hard surfaced stator-rotor assembly having a number of different configurations including an internal conically shaped cavity. Some stator-rotor assemblies are ground to precision tolerances. Such close running parallel perimeters allow for the production of particle sizes in the micron range. Further, the use of rotor teeth intermeshing with concentric stator rings having perforations results in high energy shearing and dispersion of solids/liquids suspensions as well as liquid/liquid suspensions, all made possible or enhanced by the ability to adjust the position of the rotor relative to the stator. Other features include the use of a mechanical seal cartridge to clamp the machine's thrust bearing in place, thus providing for a minimum of shaft deflection and run-out. This configuration improves the longevity of the mechanical seal and insures that the stator-rotor assemblies maintain alignment.

It is an object of the present invention to provide an improved apparatus for the sizing and dispersion of solids in a liquid slurry through the use of a variety of interchangeable stator and rotor assemblies.

A further object of the present invention is to provide an improved apparatus for the reduction of solids using an intermeshing configuration of stator and rotor components utilizing a stationary fine grind ring surrounding the rotating rotor in a manner whereby openings in the fine grind ring co-act with rotor teeth to dramatically increase the number of shears produced per revolution of the machine rotor.

It is also an object of the present invention to provide an improved apparatus for adjusting the position of the rotor relative to the stationary stator so that the machine can be adjusted for various drive configurations, for component wear, and for the particle size required to be produced.

An additional object of the present invention is to provide an improved apparatus for the reduction of long, stringy, or oversized solids through the use of a removable and replaceable shear bar mounted stationary in the inlet of the in-line grinder in a manner whereby the shear bar comes in close proximity to the revolving rotor hub so that material is sufficiently sheared and reduced prior to enter the grinding chamber formed between the stator and rotor.

A further object of the invention is to provide an improved method and apparatus for minimizing shaft deflection and run-out through the use of a mechanical seal cartridge to clamp the drive shaft bearing in place, thereby minimizing the overhung distance from the bearing support to the rotor.

It is a further object of the present invention to provide an interchangeable stator rotor assembly capable of the fine grinding of friable materials, such as drill cuttings, minerals, pigments, clays, and the refining of fibrous materials such as paper pulp, as well as high energy shearing and dispersion of solids and liquids.

An additional object of the present invention is to provide a system, utilizing an interchangeable adjustable stator-rotor disk attrition mill, for the refining and dispersion of drill cuttings produced during the drilling of oil and gas wells, particularly in offshore well drilling operations. In accordance with an important aspect of the present invention, drilling cuttings returned to the surface are separated from the drilling fluid, mixed with a suitable liquid, such as sea water, and circulated and sheared by an in-line grinder to reduce the cuttings particles to a size which forms a slurry-like composition which may be pumped into a selected zone in a wellbore for disposal.

In accordance with yet a further aspect of the present invention, there is provided a system which is advantageously used in conjunction with offshore well operations for receiving drill cuttings, reducing the size of the drill cuttings, and blending the drill cuttings with a suitable carrier liquid, such as sea water or waste water, so that a slurry-like composition may be pumped into a wellbore, preferably into and through an annular zone between the wellbore casing and an earth formation, for fracturing and permeation into the formation. The system is particularly effective, compact and adapted for use in conjunction with offshore well drilling operations.

In accordance with another aspect of the present invention, a method is presented for automatic control of the drill cuttings preparation process whereby the density, viscosity, and flow characteristics of the injected cuttings can be automatically monitored and adjusted to provide optimum conditions to promote permeation of the formation and to prevent its plugging.

Those skilled in the art will recognize the above-described advantages and superior features of the invention together with other aspects thereof upon reading the detailed description which follows in conjunction with the drawings.

DESCRIPTION OF PREFERRED EMBODIMENTS

Figure 1:
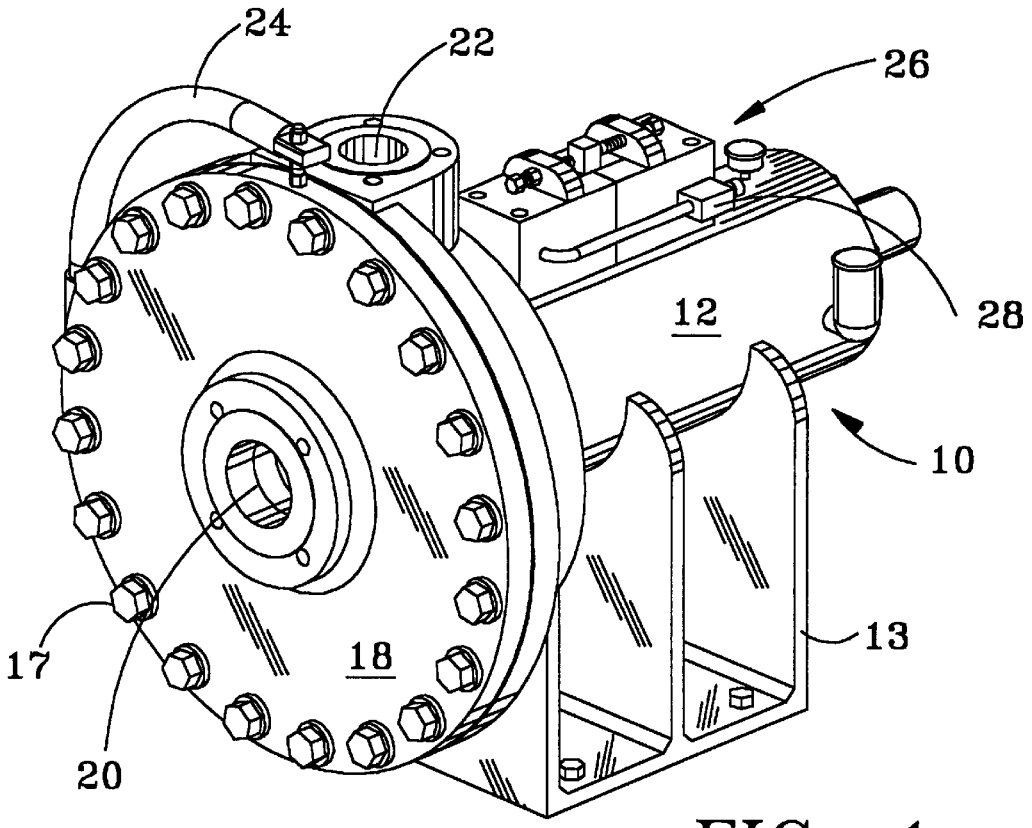
FIG. 1 is an isometric view of the preferred grinder embodiment.

In the description which follows, like parts are marked throughout the specification and drawing with the same reference numerals, respectively. The drawing figures are not necessarily to scale and certain features may be shown in schematic form in the interest of clarity and conciseness.

Figure 2:
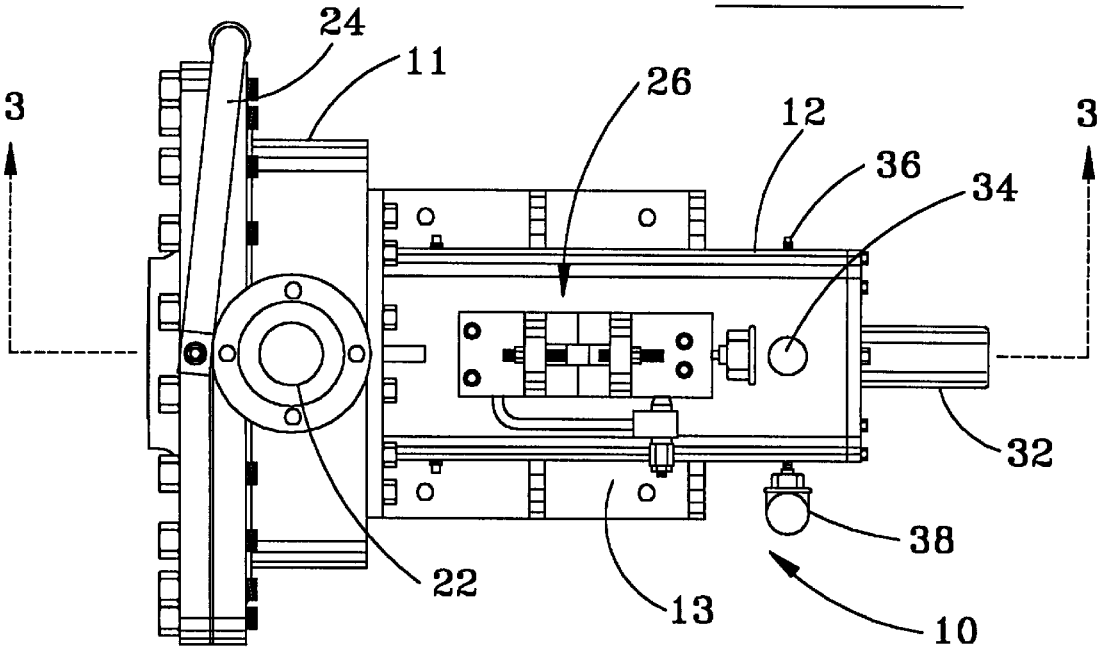
FIG. 2 is a plan view of the preferred grinder embodiment shown in FIG. 1.
Figure 6:
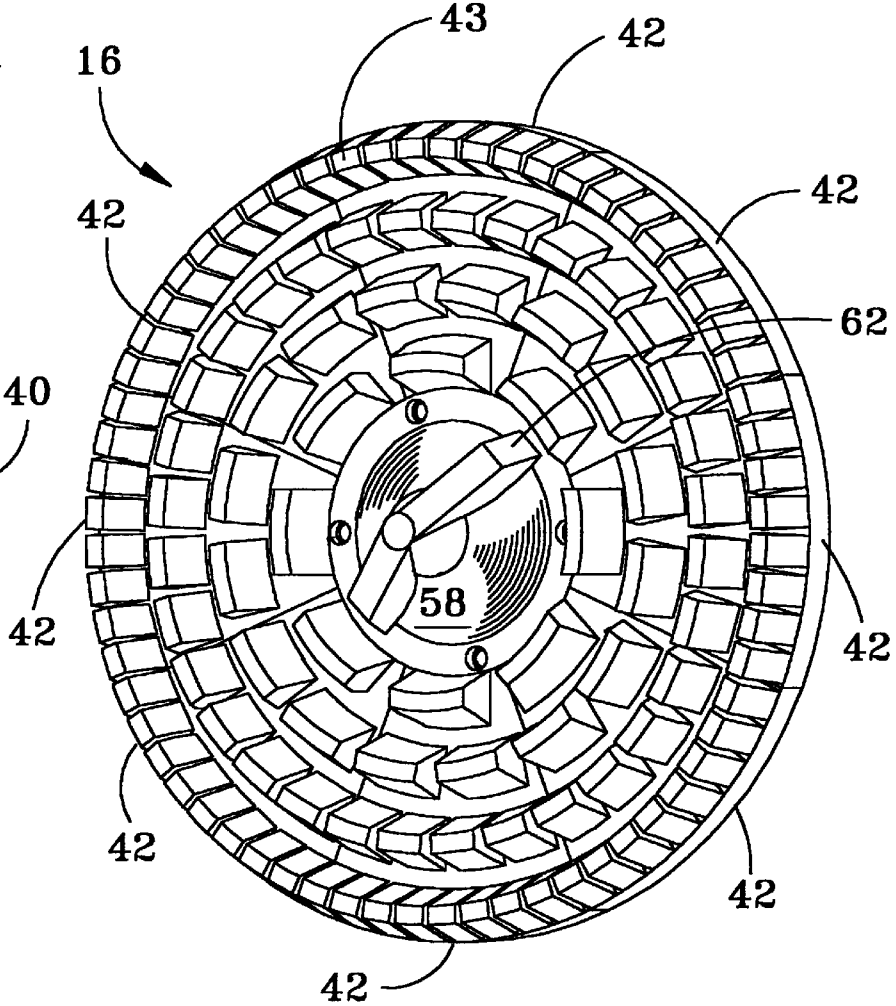
FIG. 6 Prior Art
FIG. 6 is an isometric view of the prior art segmented rotor and hub assembly shown in cross section in FIG. 3.
Figure 5:
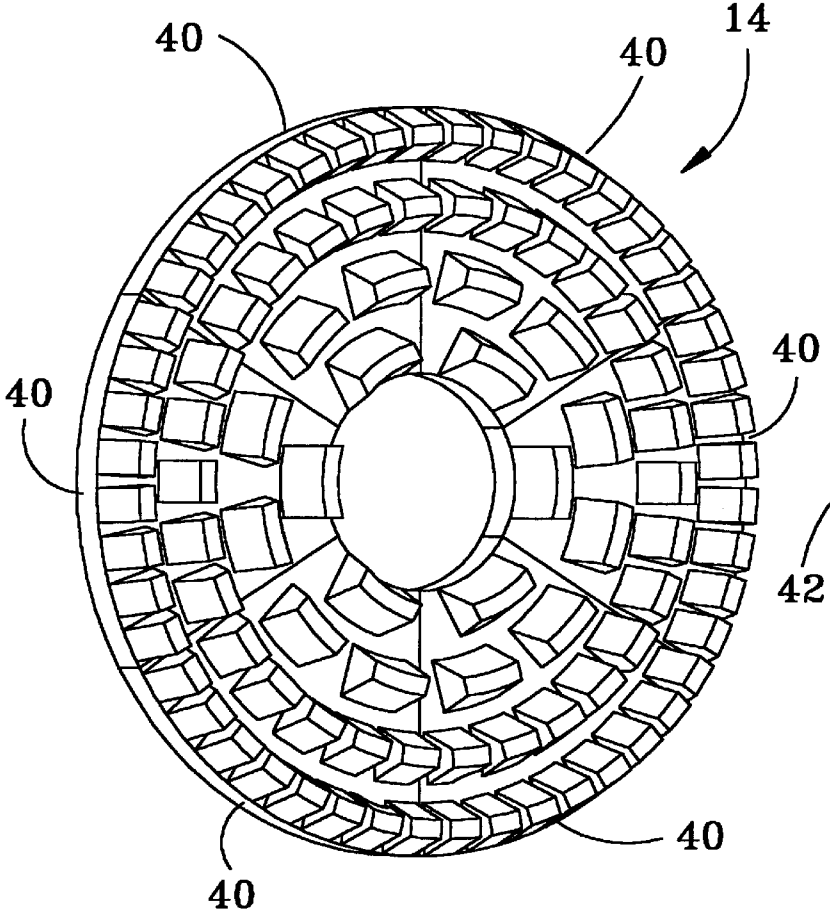
FIG. 5 Prior Art
FIG. 5 is an isometric view of the prior art segmented stator assembly shown in cross section in FIG. 3.

The in-line grinder 10 shown in FIG. 1 includes a casing 12 and a grinding chamber housing 11 better seen in FIG. 2 which houses the segmented stator and rotor assemblies 14,16 shown in FIGS. 5 and 6 and disclosed in the prior art or variations thereof illustrated in FIGS. 13–20 which collectively accomplish product size reduction as required. The casing 12 is generally supported by a mounting frame member or base portion 13. The stator/rotor assemblies are accessed through the removal of the casing cover 18 via bolts 17, which is supported by a pivot arm 24. The position of the rotor assembly 14 relative to the stator assembly 16 is adjusted through the use of a hydraulic actuator mechanism 26 located at the top of the casing 12. The hydraulic actuator 26 is also supplied with a pressure relief valve 28 on the opening side of the cylinder 26 so that the rotor assembly 16 can instantaneously move away from the stator assembly 14 in the event that the grinder 10 ingests a solid object of a size larger than the presetting and which it cannot shear. The pressure relief valve 28 can be adjusted to relieve at any setting desired as a means of tailoring the machine to individual applications. Further, the minimum gap and maximum gap which can be achieved between the stator assembly 14 and rotor assembly 16 can be manually set through adjustment of the stop gap set screws 30 shown adjacent the hydraulic actuator 26.

In operation, coarse solids slurried in liquid are introduced by pump into the suction port 20 located at the center of the casing cover 18. Sized solids are discharged through the outlet port 22 located at the top of the grinding chamber housing 11 adjacent the stator/rotor assemblies 14, 16 and at a right angle to the suction port 20. The rotor assembly 16 is rotated relative the stationary stator assembly 14 via an input shaft 32 which extends beyond the casing 12 and driven by a prime mover such as a motor. Casing vent 32, grease zerk 36 and oil cup 38 are also provided for ventilation and lubrication of the sliding and rotating components within the case 12.

Figures 3, 4:
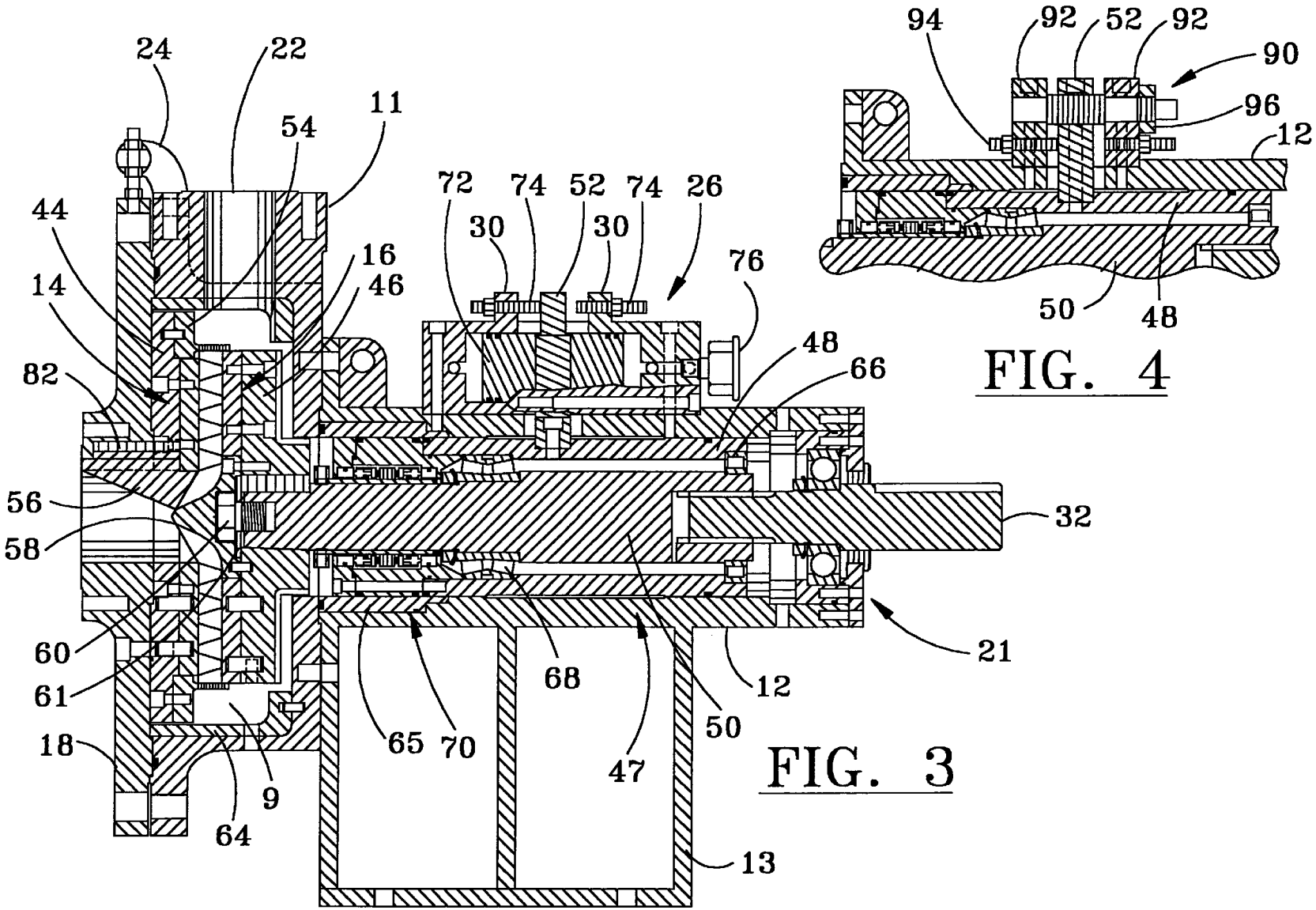
FIG. 3 is a cross-section view of the preferred grinder embodiment taken along sight line 3—3 shown in FIG. 2.
FIG. 4 is a partial cross-section illustrating a second embodiment of the rotor adjustment mechanism shown in FIG. 3.

A cross-section of the preferred in-line grinder embodiment is shown in FIG. 3. This cross-section is taken along the center line of the machine shown in FIG. 2 and features the intermeshing configuration of stator and rotor assemblies 14,16. FIG. 3 illustrates several unique features of the in-line grinder which allow the apparatus to be configured for individual size reduction applications. These features include: interchangeable stator and rotor segments 40, 42 seen in FIGS. 5 and 6 which are mounted on corresponding stator and rotor plates 44,46, such stator and rotor segments being also interchangeable with segments having various face configurations; an adjustable quill assembly comprising the quill 48, a quill shaft 50 and a unique mechanical seal and bearing arrangement 68,70 design to minimize shaft deflection and run-out, and a quill arm 52 which allows the gap between the stator and rotor assemblies 14,16 to be set for individual applications; an optional fine grind ring 54 surrounding the stator and rotor assemblies 14,16 to increase the number of shears taking place in the grinder; and a removable breaker bar 56 located in the suction port of the grinder 10 to reduce inlet solids to a selected size prior to grinding.

Figure 9:
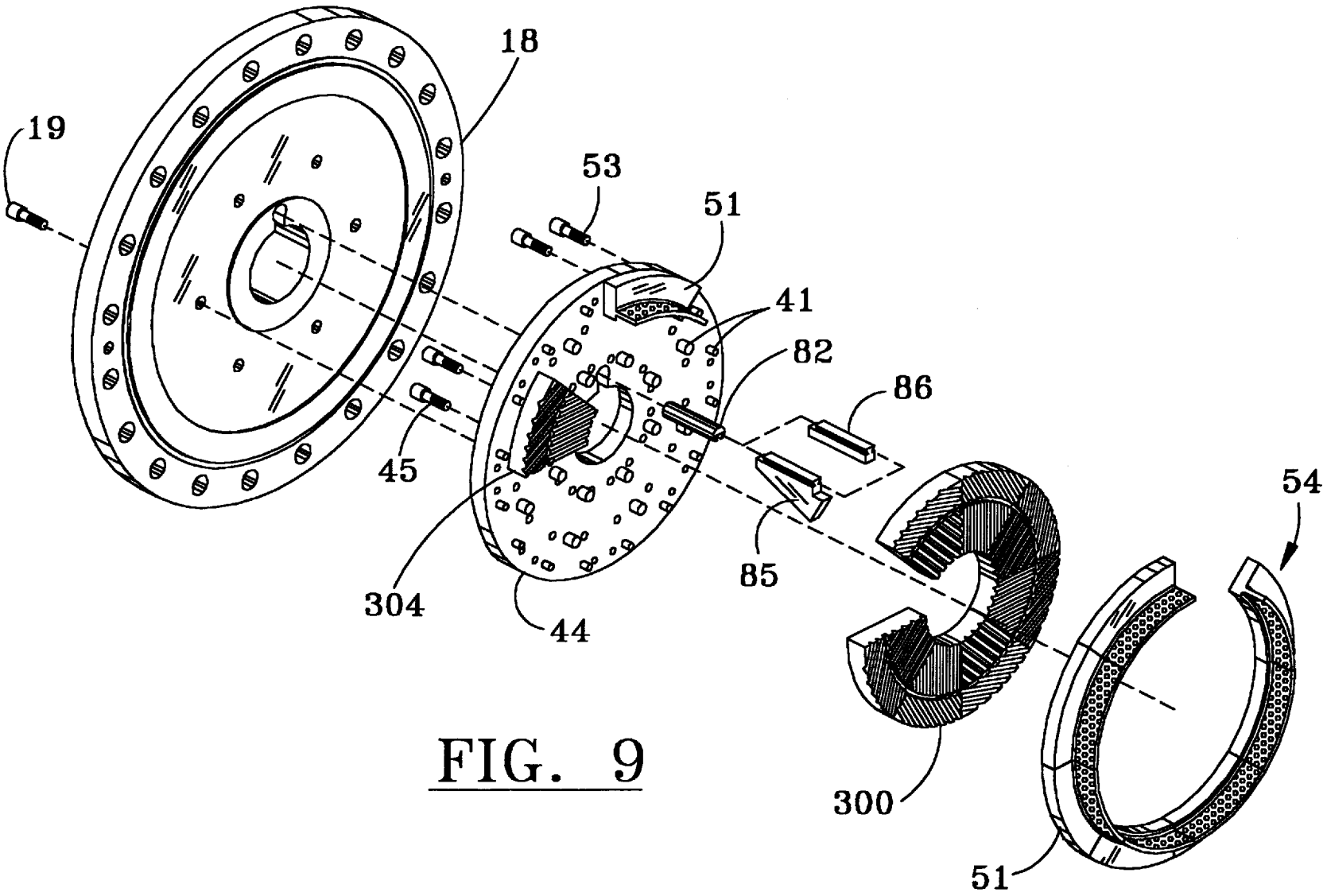
FIG. 9 is a partial exploded isometric view of the principle elements of the preferred embodiment.

As best seen in FIG. 9, stator assembly 300 and its segments 304 are mountable to a single stator plate 44 which is in turn mounted to the casing cover 18. Likewise, rotor assembly 302 and its segments 304 are mountable to the rotor plate 46 seen in FIG. 9A, which is also keyed via a shaft key 35 and retained to the quill shaft 50 via a rotor bolt 60 and washer 61. The rotor hub 58 seen in FIG. 9A covers the rotor mounting bolt 60 and directs flow into the grinding chamber formed by the co-action between the stator and rotor assemblies 300, 302. The rotor hub 58 may also be supplied with one or more flights 62, illustrated in FIG. 6. This arrangement allows the mounting of a multitude of different configurations of stator and rotor segments, seen in FIGS. 13–20, within the same grinder chamber 9 configuration seen in FIG. 3 in order to tailor the grinder 10 to individual applications. These stator/ rotor assemblies may have intermeshing features as seen in FIGS. 5 and 6 or non-intermeshing features as seen in FIGS. 13–20, depending upon the application. However, FIG. 3 illustrates rotor and stator grinding assemblies 14,16 as being the intermeshing type detailed in FIGS. 5 and 6 and discussed in our previous patents, as contained within the grinding housing 11 attached to the front portion of the casing 12 and accessed by opening the casing cover 18. As also seen in FIG. 3 the interior grinding chamber 9 of the grinding housing 11 is protected from wear by a replaceable wear ring 64 as best seen in FIG. 26.

Figure 9A:
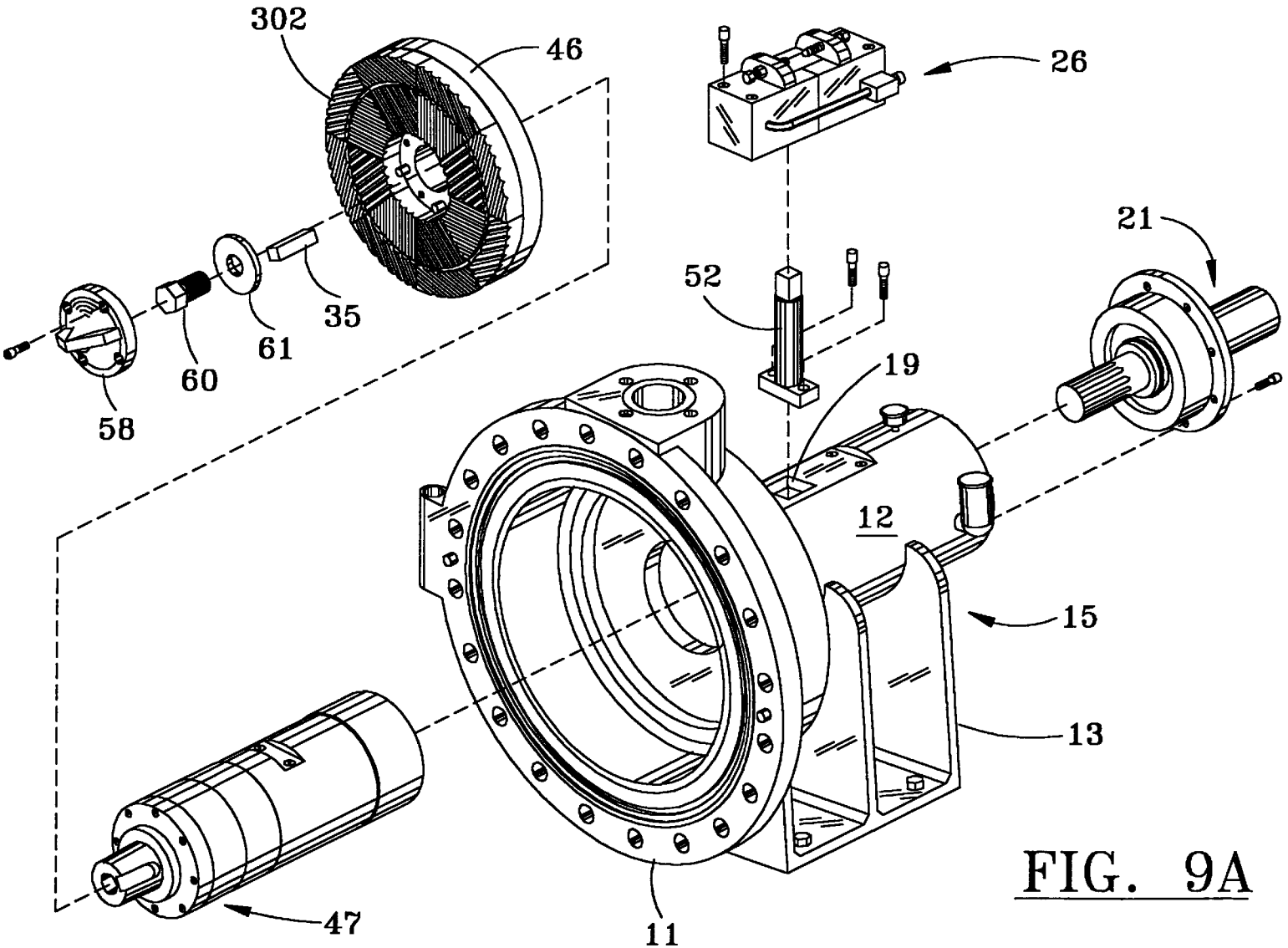
FIG. 9A is a continuation of the exploded view of the principle elements of the preferred embodiment illustrated in FIG. 9.

As seen in FIG. 9A the quill assembly 47 is held in a slidable position inside the casing assembly 15 and further retained in linear non-rotatable relationship with the case portion 12 by the quill arm 52 attached to the quill assembly 47 and passing through a slot 19 in the case portion 12. The drive assembly 21 attaches to the end of the casing 12 and is spline linked to the quill assembly 47, thereby allowing linear travel of the quill assembly 47 relative to the drive assembly 21. The hydraulic actuator assembly 26 is positioned over the quill arm and attached to the case portion 12, thus providing remote sensing or control of the quill assembly 47 thereby effecting positioning of the stator/rotor spacing.

Figures 23, 24, 25:
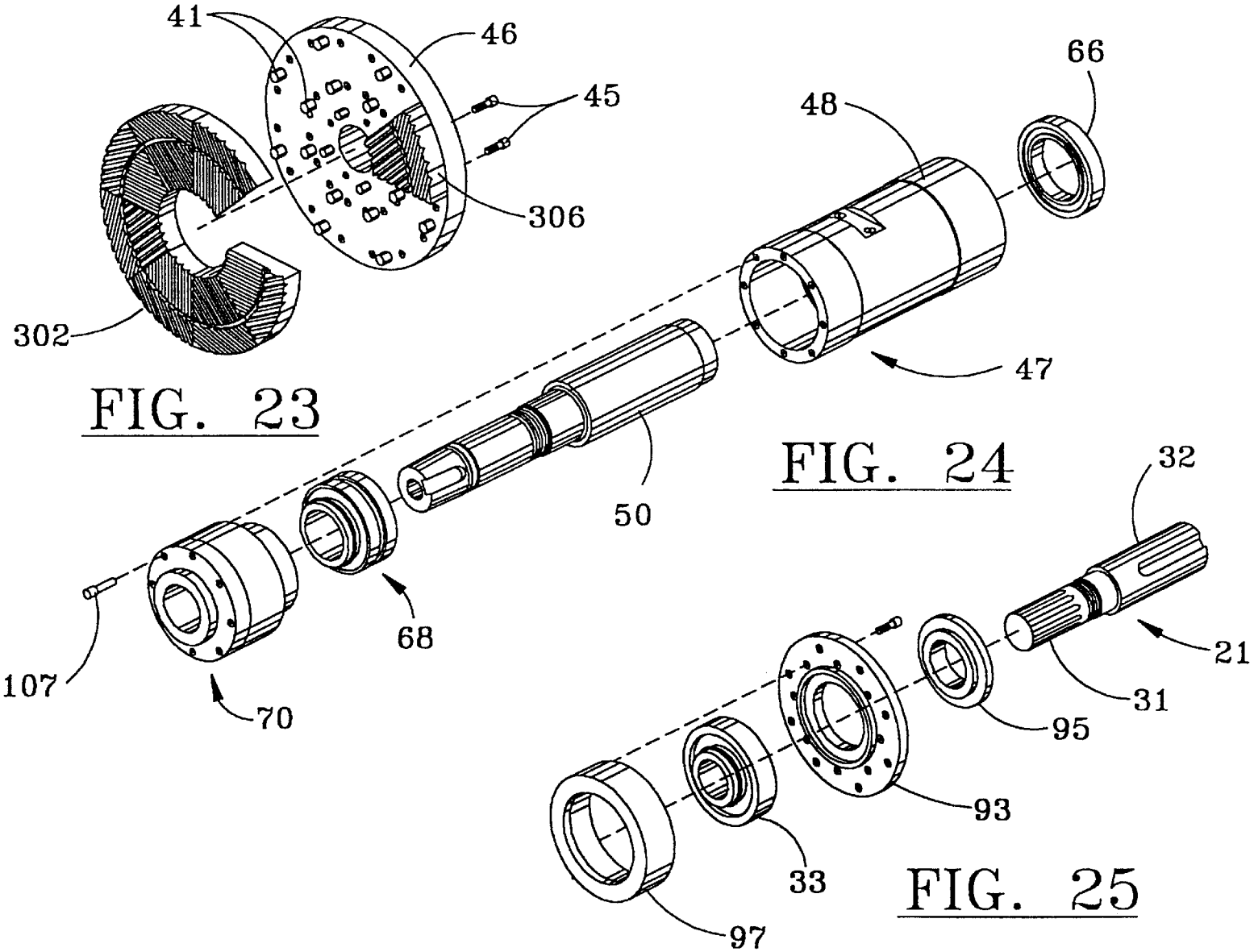
FIG. 23 is an exploded view of the rotor assembly and rotor plate illustrated in FIG. 9A.
FIG. 24 is an exploded view of the rotor shaft and quill assembly illustrated in FIG. 9A.
FIG. 25 is an exploded view of the drive assembly illustrated in FIG. 9A.

As better seen in FIG. 24, the quill assembly 47 is comprised of a quill or rotor shaft 50 slidable within the quill body 48 rotatable within a unique mechanical seal 70 and thrust bearing assembly 68 integral with and attached to the front portion of the quill 48. The thrust bearing 68 is held in position by its inner race located on a shoulder of the shaft 50 and secured by a threaded lock nut 57 and washer 59 with its outer race in contact with an inside bore of the quill 48. This arrangement is essential in minimizing shaft deflection and run-out. The arrangement further improves the life of the mechanical seal 70 and maintains critical alignment between intermeshing stator and rotor assemblies 14,16 seen in FIG. 3 and detailed in FIGS. 5 and 6. A roller bearing 66 is also secured to the rear portion of the shaft 50 for supporting the shaft within the quill 48.

Figure 26:
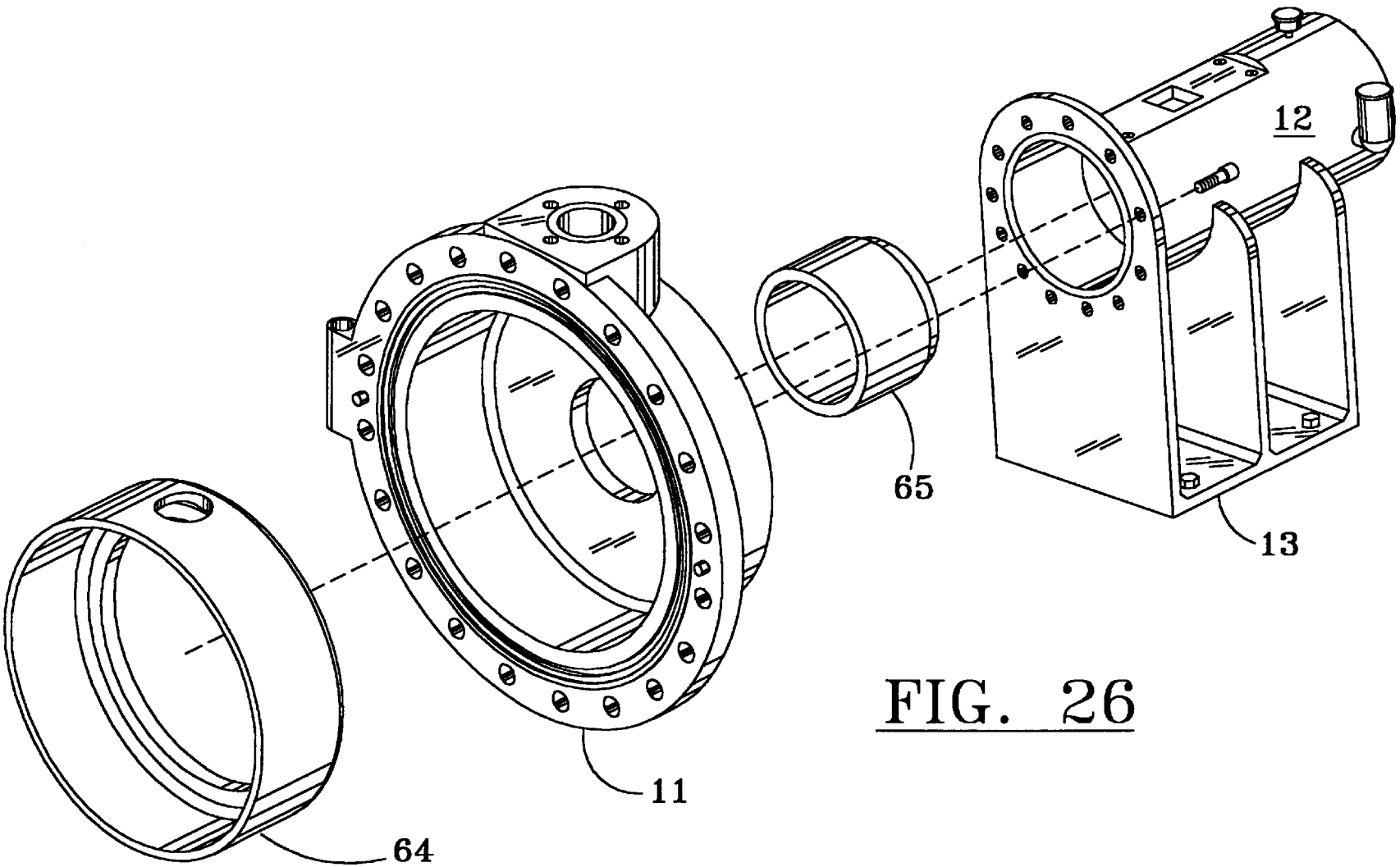
FIG. 26 is an exploded view of the case assembly Illustrated in FIG. 9A.

Since the rotor 46 and quill assembly 47 all move linearly as a single unit inside the bore of the casing 12. a wear sleeve 65 is provided as seen in FIG. 26. Seal rings 77 are also provided in grooves around the exterior of the mechanical seal assembly 70 and at each end of the quill 48 in slidable contact with the wear sleeve 65 and interior bore of the quill 48. An internal spline in the rear end of rotor or quill shaft 50 is cooperative with external spine on the front end of the drive shaft 32, thereby making a slidable connection 31 between the quill shaft 50 and the drive assembly 21, as seen in FIG. 3 in a manner so that the quill assembly 47 can be moved linearly while the drive shaft 32 remains fixed. As seen in FIG. 25 the drive assembly 21 is comprised of a stub shaft 32 which has an external spline 31 at one end and an exterior portion 91 which may be splined or keyed as required at the opposite end; a bearing flange 93 having a lip seal 95 attached to one side and a bearing housing 97 secured to the opposite side, the bearing flange 93 which is fixable to the end of the casing 12; and a bearing 33 rotatable about the stub shaft 32, the bearing and bearing housing is located inside the longitudinal bore of the casing 12.

As seen in FIG. 3, the quill assembly 47 held in position by the quill arm 52 which projects through the casing 12 and attached to the sliding quill 48 is in turn held in position by the piston 72 contained inside the hydraulic actuator 26. With this arrangement, application of pressurized hydraulic fluid to either side of the piston 72 will cause the entire rotor 46 and quill assembly 47 to move in unison. The range of possible movement of the quill arm 52 can be adjusted through the use of the stop gap set screws 74 located on top of the hydraulic actuator 26. The relief valve 28 seen in FIG. 1 may be adjusted to relieve at any pressure desired by referencing the pressure gauge 76 mounted on the end of the hydraulic actuator assembly 71.

Figure 7:
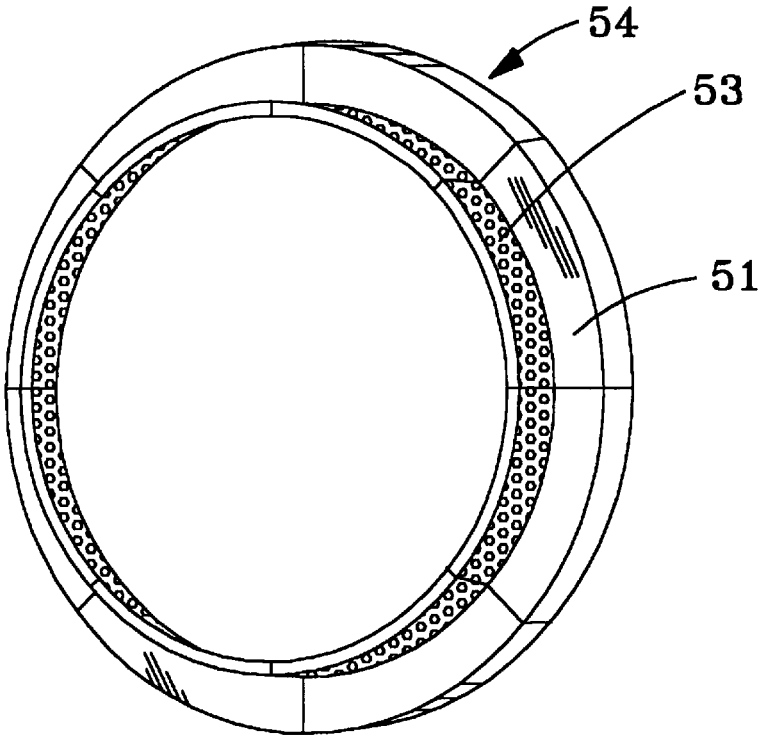
FIG. 7 is an isometric view of the fine grind ring shown in cross section in FIG. 3.

An optional fine grind ring 54, seen in FIG. 7, may be mounted to the stationary stator plate 44, thereby surrounding the rotating rotor assembly 16 with a minimum of clearance between the two. The fine grind ring 54 may be furnished with a variety of hole sizes in the ring portion of the piece so that a desired particle size can be selectively produced. Each hole 53 in the fine grind ring co-acts with each tooth 43 on the outer stage of the rotorl6 seen in FIG. 6 to drastically increase the number of shears occurring in the grinder. For example, a machine turning 1800 RPM will produce approximately 15 million shears per minute without a fine grind ring 54. The addition of a fine grind ring 54 having ¼" diameter holes can increase the number of shears occurring to 62 million per minute. A ring with one eighth inch diameter holes can be made to produce 212 million shears per minute and 1/16" diameter holes to produce 800 million shears per minute. The ring portion of the piece is typically perforated with holes to yield a pattern which is 40% open. The unique use of a fine grind ring with ¼" diameter holes in association with the intermeshing stator and rotor shown in FIGS. 5 and 6 has proven to reduce 80% of a limestone gravel sample to 178 microns and 10% of the sample to 140 microns. An even finer particle size is possible through the use of a fine grind ring having smaller perforations.

Figure 8:
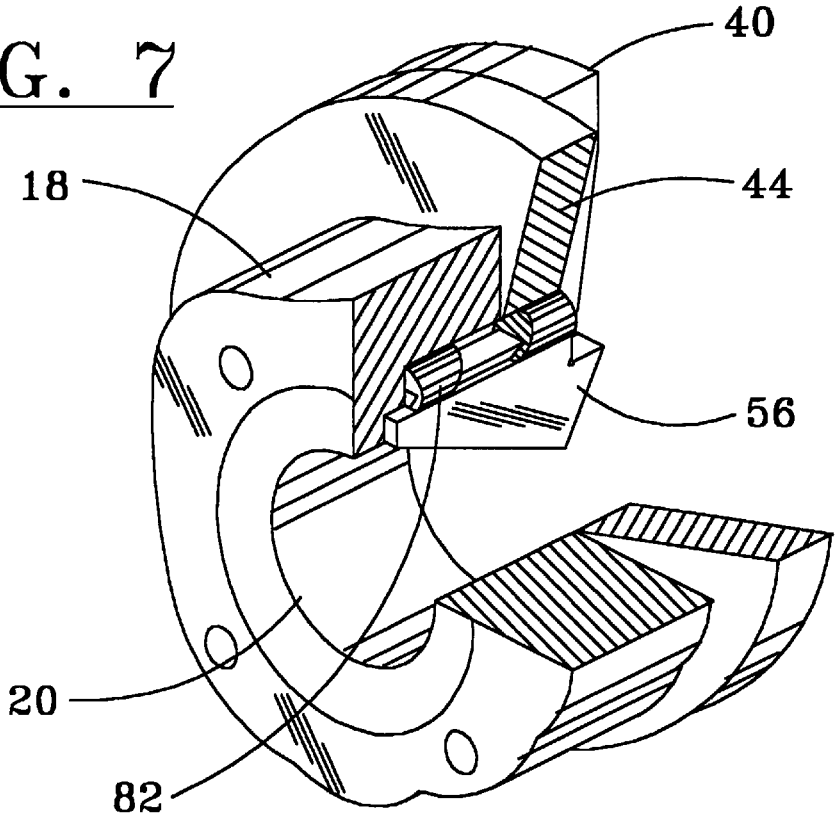
FIG. 8 is a partial cut-a-way isometric view of the casing cover, stator plate and segmented stator illustrating breaker bar location.

As seen in FIGS. 8 and 9, a removable breaker bar 56 may be inserted into a retainer rod 82 and inserted corresponding into a cavity 84 in the casing cover 18 and stator plate 44 to reduce oversized materials which are too large or stringy to be ingested into the suction port 20 of the grinding chamber formed by the stator and rotor assemblies 14,16. The stationary breaker bar 56 co-acts with the flighting 62 on the rotor hub 58 as shown in FIG. 3 to shear material and provide the first size reduction stage. For applications not needing this feature, a cavity insert blank 86 may be used which fills and protects the breaker bar cavity 84 formed in the casing cover 18. The breaker bar 56 is typically heat treated to a Rockwell "C" scale hardness of 65, but it can also be overlaid with tungsten carbide or diamond chips.

FIG. 4 illustrates a manual means of adjusting the rotor-quill assembly 47 through the use of a gap adjustment shaft 90. The gap adjustment shaft 90 is captured between two stationary blocks 92 mounted to the casing 12 and the center portion of the gap adjustment shaft 90 is threaded. The quill arm 52 is likewise threaded so that rotating the shaft 90 causes the quill arm 52 to move. A lock nut 96 is used to clamp the gap adjust shaft 90 in place after adjustments have been made. Gap stop set screws 94 are likewise used to govern the extreme travel of the quill arm 52 in either direction.

FIGS. 5 and 6 illustrate one of the many intermeshed stator-rotor configurations mountable within the in-line grinder. A cross-section of this configuration is included in FIG. 3. The teeth protruding from the surface of the stator and rotor travel in the valleys formed in the opposing segments so that the teeth actually intermesh and co-act with one another to shear material as it travels radially from the suction 20 to the discharge port 22 of the grinding apparatus 10. It is essential that the stator and rotor assemblies 14, 16 be segmented to allow heat treating of the components to a Rockwell "C" scale of 65 without distortion. Heat treating a single piece stator and rotor produces unacceptable distortion and thus renders them unusable.

Figure 27:
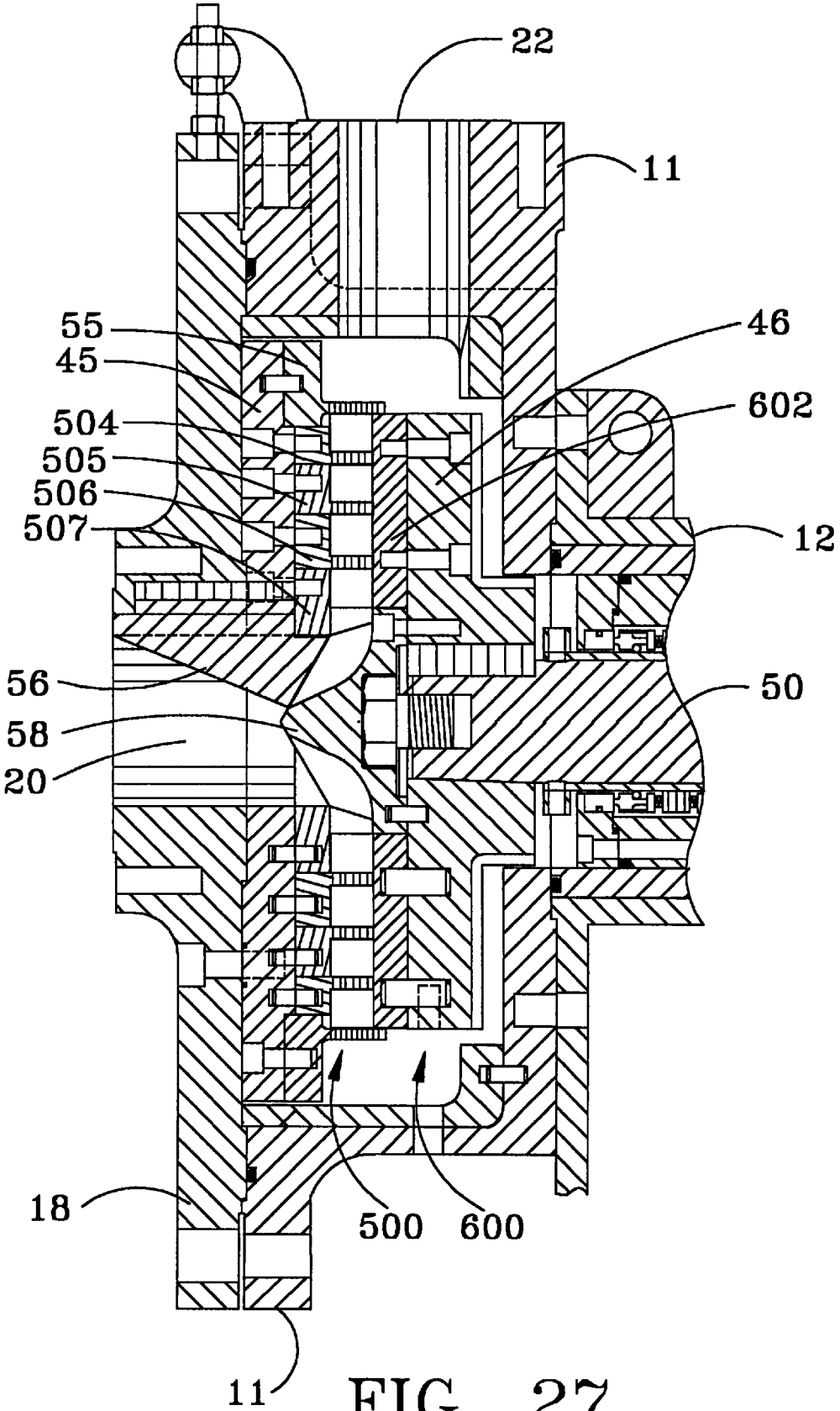
FIG. 27 is a partial cross section view of the preferred grinder embodiment with combination intermeshed stator shear ring assembly and segmented rotor assembly having teeth similar to that shown in FIG. 6.
Figure 28:
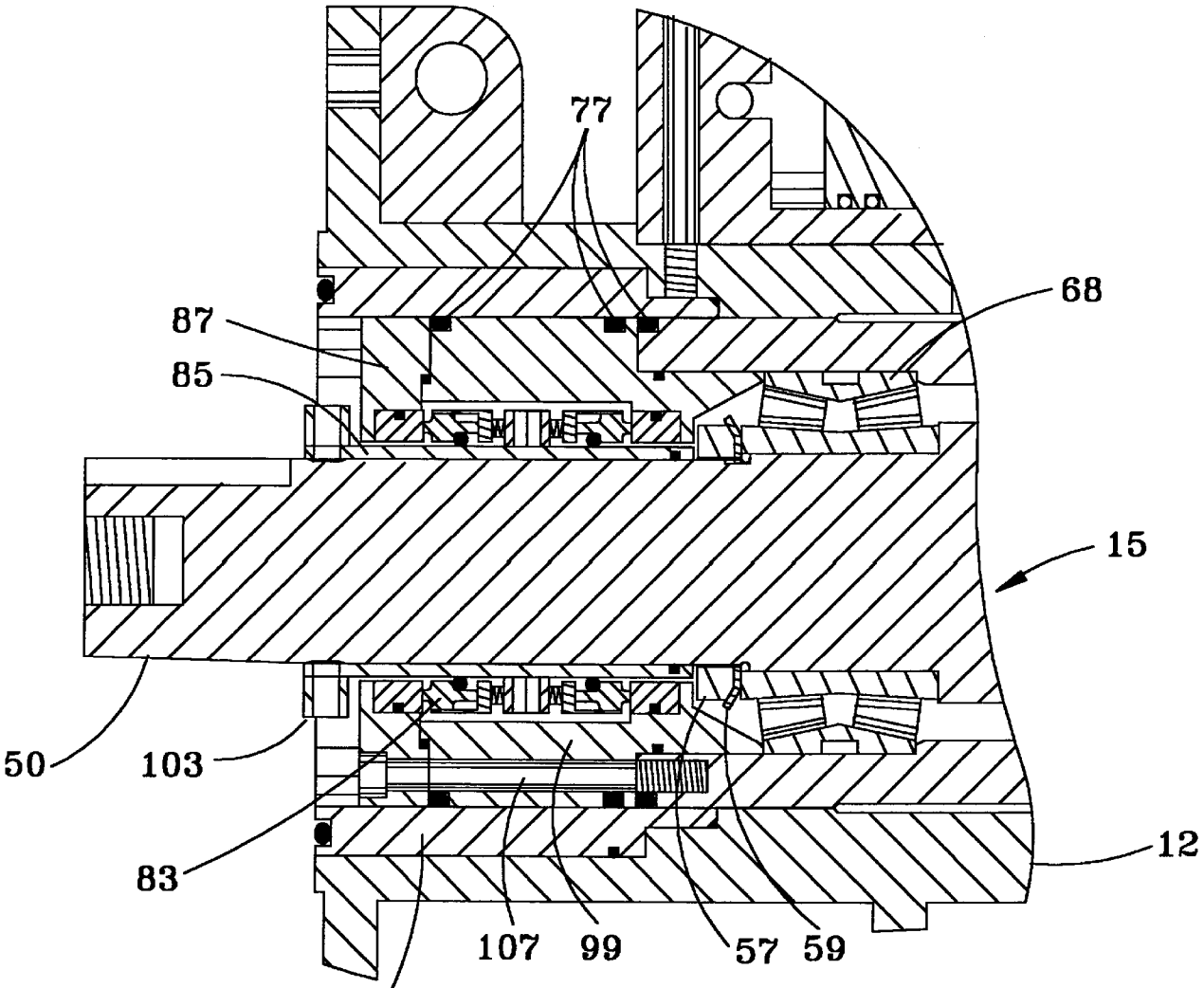
FIG. 28. is an enlarged view of a portion of the cross section view in FIG. 3.
Figure 32:
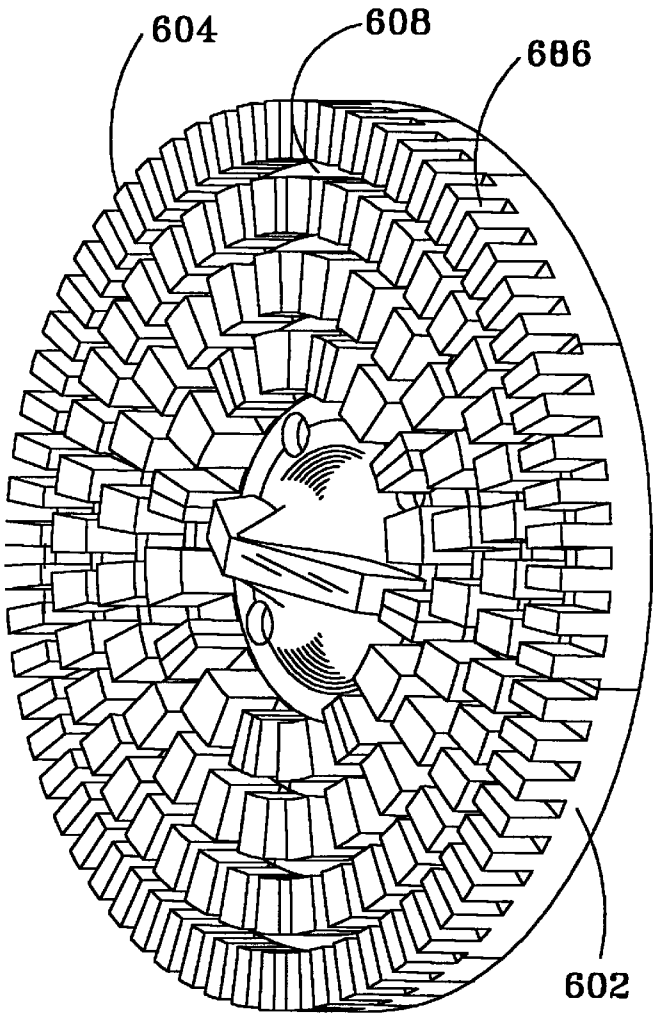
FIG. 32 is a segmented rotor having teeth cooperative with teeth and rings of FIG. 31.
Figure 34:
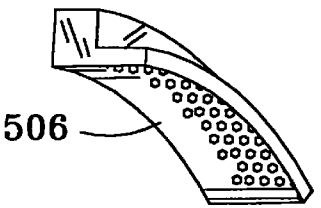
FIG. 34 is a detailed isometric view of a ring segment illustrated in FIG. 31.
Figure 33:
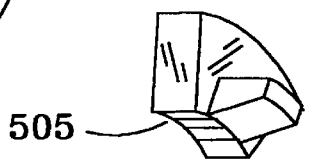
FIG. 33 is a detailed isometric view of a tooth segment illustrated in FIG. 31.
Figure 31:
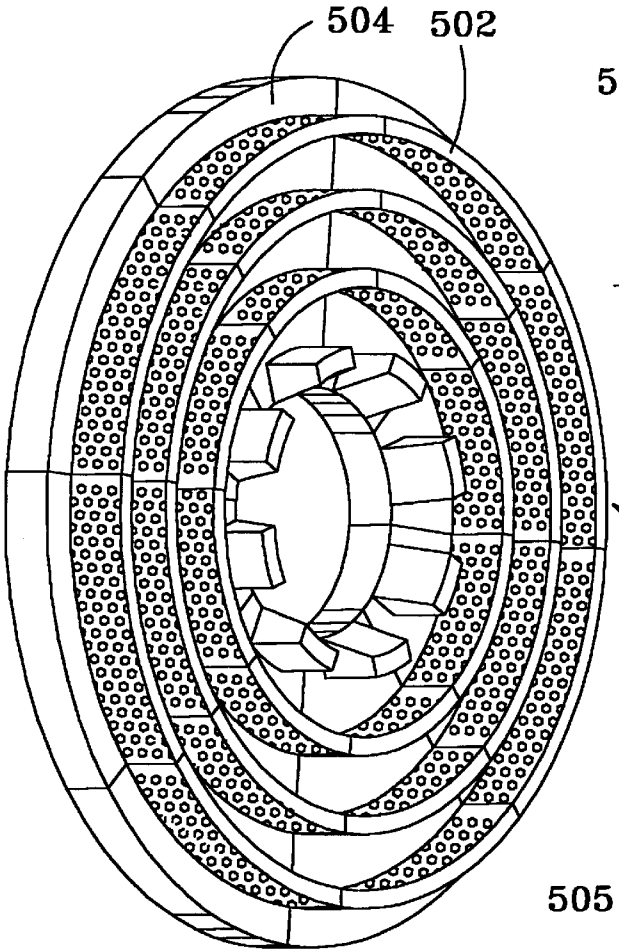
FIG. 31 is a segmented stator shear ring assembly.

A similar combination of intermeshing stator and rotor assemblies is shown in cross section FIG. 27, and in detail in FIGS. 31 and 32. The stator assembly 500 shown in FIG. 31 is composed of a series of concentric rings 502 which have holes or perforations in them. The holes in the stator rings can be ¼", ⅛" or 1/16" in diameter and the open area of the perforations is typically 40% of the ring's surface area. The rings 502 and their base portion 504 may be made as a single diametrical element or in pie shaped segments as seen in FIG. 34 forming a diametrical disk. The rings 502 and their base portion 504 may be provided as one piece diametrical rings forming concentric circles and attached to the stator base plate 44 via dowels 41 as illustrated in FIG. 27. The rings 502 and base portion 504 as seen in FIG. 34 may also be furnished as segmented rings, necessary only if they are to be heat treated to improve wear resistance, in which case a series of pie shaped concentric ring segments as seen in FIG. 34 forms a wedge or pie shaped segment for attachment to the stator plate 44 shown in FIG. 27.

A row of teeth segments 505 as seen in FIG. 31 may also be integrated into the pie shaped segments shown in FIG. 31 or as a one piece diametrical concentric ring and also attached to the stator base plate 44. These teeth segments 505 are cooperative with the rotor tooth segments 604 illustrated in FIG. 32.

The rotor illustrated in FIG. 32 may also be made in one piece 33 in diametrically concentric rings or in pie shaped segments which bolt to the rotor base plate 46 in identically the same manner as the rotor assemblies described earlier. The segments 602 may be provided as investment castings with rows of teeth 604 having gaps 606 between teeth and gaps 608 between rows which get progressively narrower and more numerous in each successive row emanating from the epicenter of the disk. The sides of the teeth 604 are perpendicular to their base 602, instead of being tapered as illustrated in earlier rotor assemblies illustrated herein, and in a manner so that they fit within 0.010" of the stator rings 502 shown in FIG. 31 when rotating in a cooperative manner. The purpose of the configuration illustrated in FIG. 27 is to introduce a high number of shears per revolution of the rotor for the energetic mixing and dispersion of liquid solutions as well as powder/liquid solutions. It would typically be used by the chemical industries and those industries which must intimately and thoroughly mix and disperse materials in their manufacturing processes, such as inks, pigments, dies, powders, etc.

Figure 10:
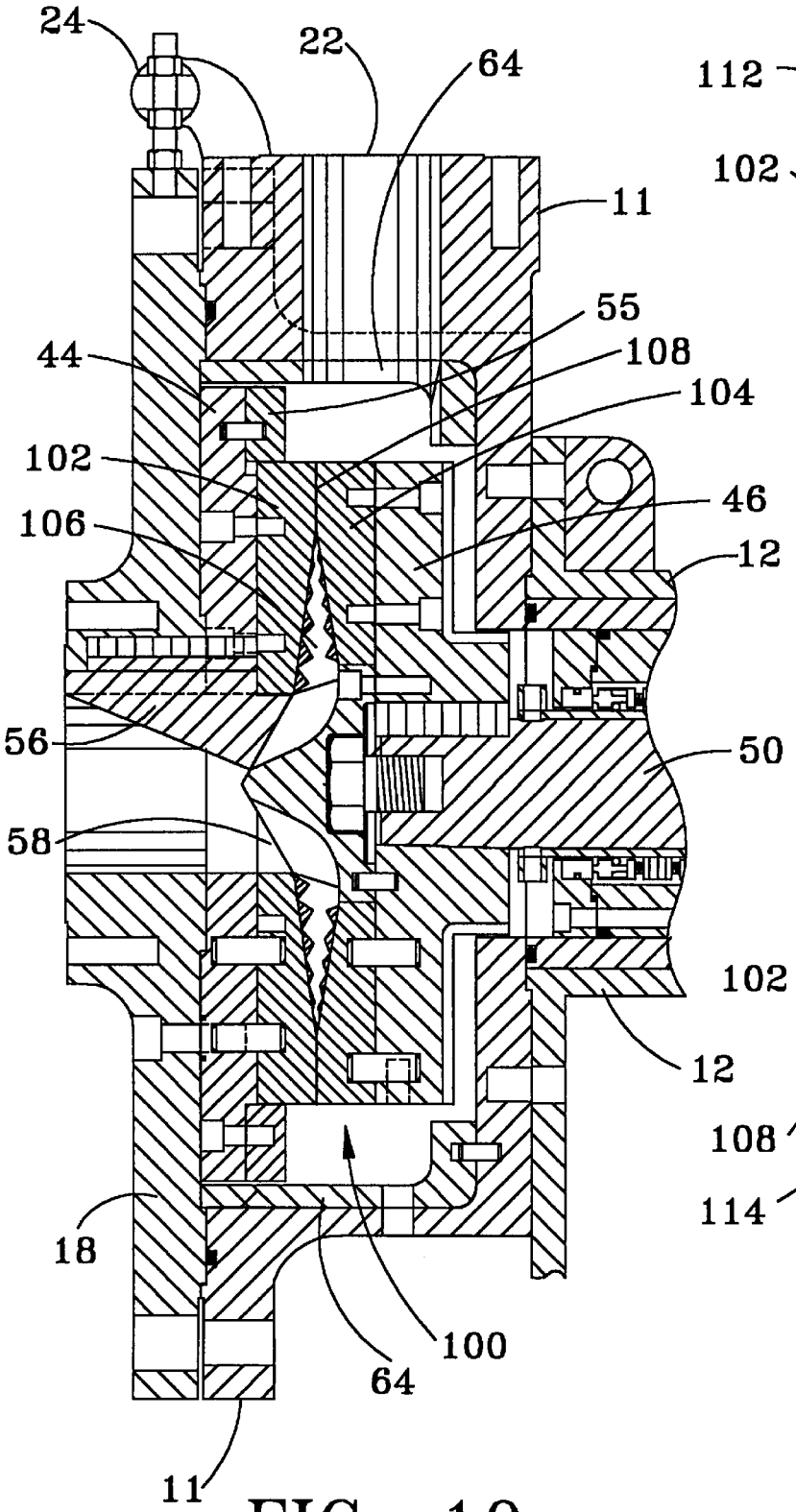
FIG. 10 is a partial cross section view of the preferred grinder embodiment with non-intermeshed stator-rotor assembly.
Figure 11:
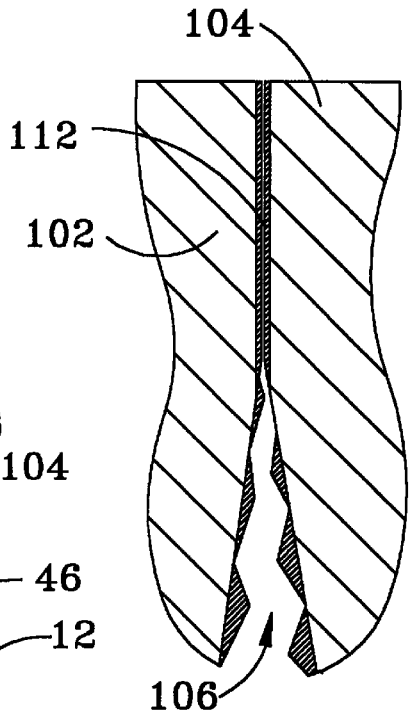
FIG. 11 is an enlarged partial cross-section view of the with non-intermeshing stator/rotor assembly illustrated in FIG. 10.
Figure 12:
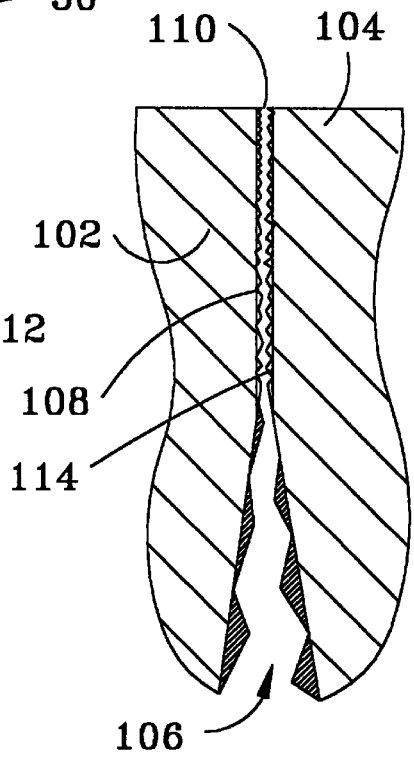
FIG. 12 is an enlarged partial cross-section second embodiment of the stator/rotor assembly.
Figure 14:
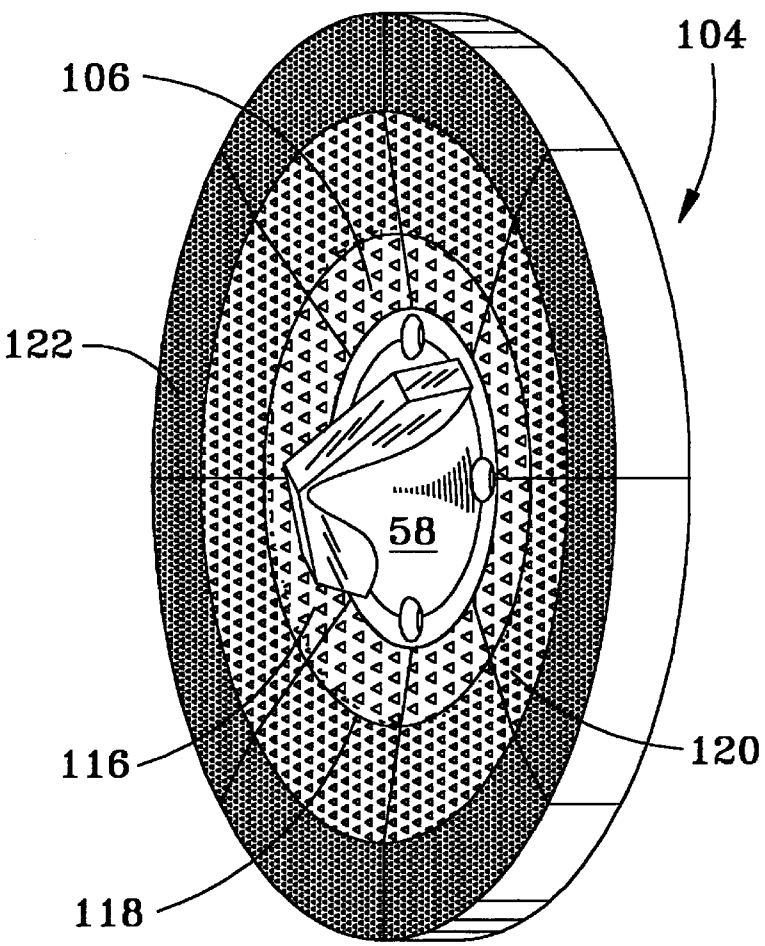
FIG. 14 is an isometric view of the segmented non-intermeshing rotor and hub assembly.
Figure 13:
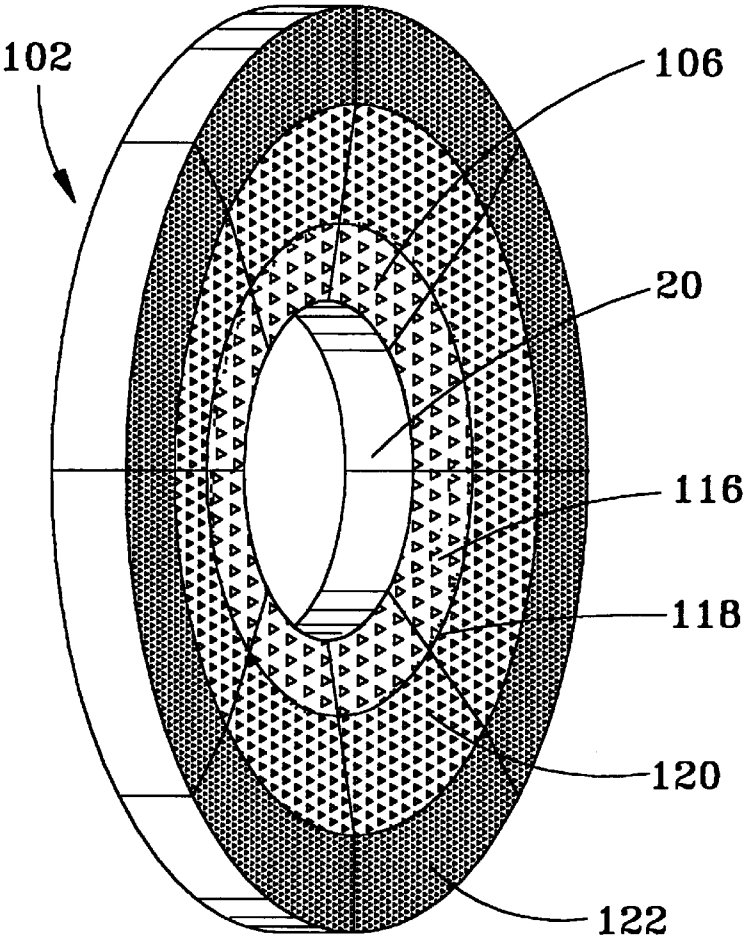
FIG. 13 is an isometric view of the segmented non-intermeshing stator assembly.

Turning now to FIG. 10 we see a partial cross-section view of a non-intermeshing stator-rotor assembly 100 which has been developed for the effective reduction of friable material to a micron particle size. Friable material will typically shatter upon impact with another object. This principle applies whether the material is impacted from an outside source or from attrition with another similar material. This non-intermeshing stator-rotor configuration of the type illustrated in FIGS. 13 and 14, comprising a segmented stator assembly 102 and segmented rotor segmented 104, effectively uses the impact principle of operation by forming a conically shaped coarse grinding cavity 106 seen in FIG. 11 between the two assemblies at the center or sloped portion of the stator-rotor assembly 100 and a fine grinding portion 108 seen in FIG. 12 at the assembly's planar outer or perimeter portion. The basic pie shape of the segments, as further detailed in FIGS. 13 and 14, are produced in base metal such as 4340 alloy steel and the segments are then overlaid with a tungsten carbide or diamond chip matrix to provide a wear resistant surface. The fine grinding section of the stator-rotor assembly 100 is formed by the planar or outer perimeter portion of the rotor assembly 104 running in close proximity and essentially parallel to the outer perimeter portion of the stator assembly 102. The corresponding gap 110, seen enlarged in FIG. 11 between the stator and rotor sections 102,104, ultimately determines the maximum particle size that can be released from the grinding chamber 11 through port 22. Therefore, the roughness height should be established at between 32 and 500 micro-inches. It should be noted that the fine grind ring 54 illustrated in FIG. 7 is not necessary with the fine grinding stator-rotor assembly 100, therefore a blank ring 55 is used in its place. FIG. 11 also shows a typical method of constructing the fine grinding portion 110 of the stator-rotor assembly 100 by overlaying opposing face portions of each segment of the rotor and stator 102, 104 with hard surfacing material in a matrix, such as smooth tungsten carbide or diamond dust 112, and then grinding it flat with a diamond grinder so that both stator and rotor surfaces run true relative with each other. An alternate means of constructing the fine grinding section 108 is shown in FIG. 12 where tungsten carbide or diamond chips 114 are overlaid on the surface to form a multitude of randomly shaped teeth. In operation, the corresponding rough surface produced on the stator and rotor segments in both the conical cavity 106 and the find grind section 108 effectively reduces material passing through the rotating rotor-stator assembly 100 to micron size particles.

Figure 15:
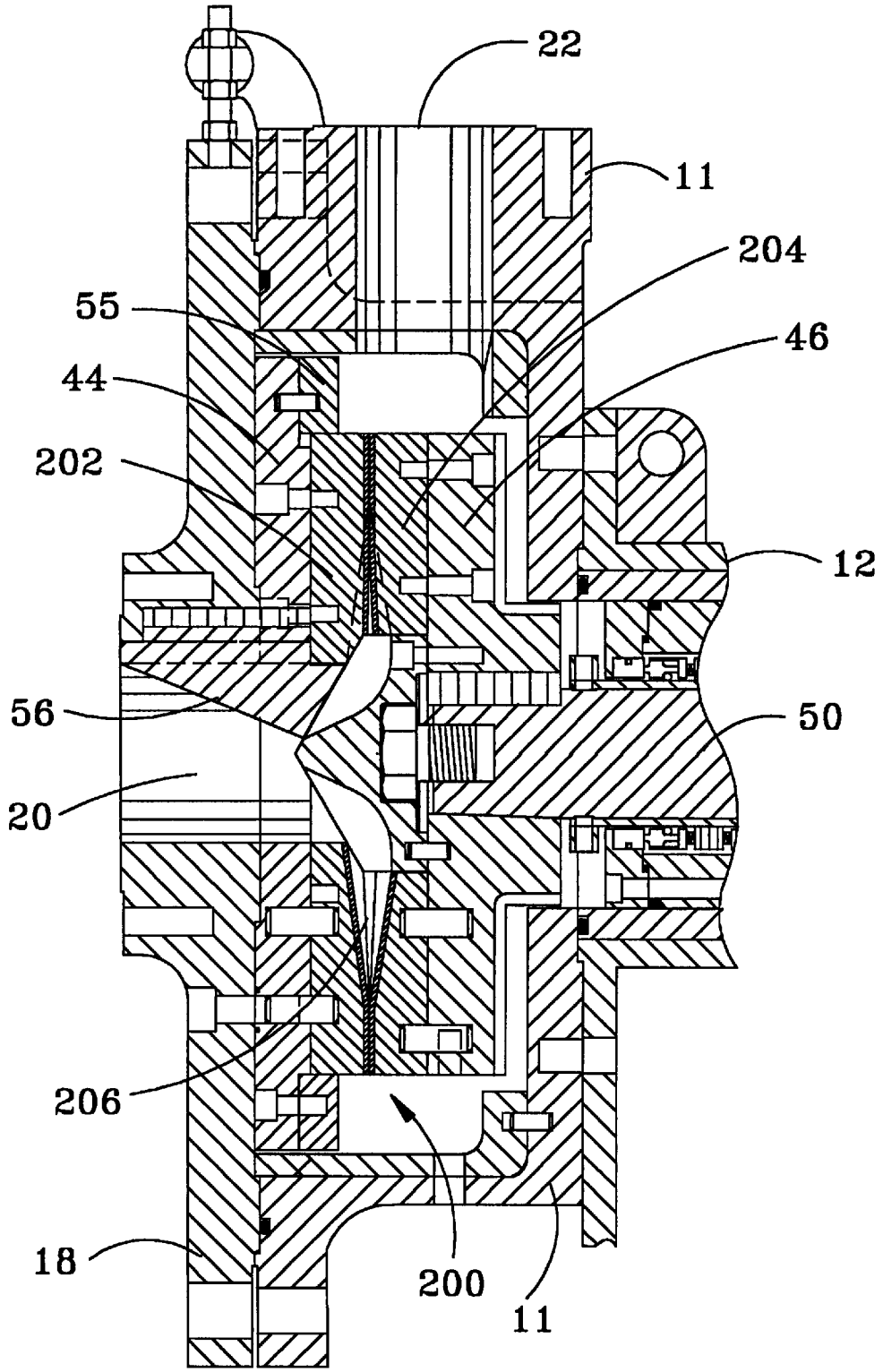
FIG. 15 is a partial cross-section view of the preferred grinder embodiment with a third embodiment for the non-intermeshing stator-rotor assembly.

FIG. 14, illustrating the segmented stator 102, and FIG. 15, illustrating the segmented rotor 104, show this non-intermeshing stator and rotor configuration from a perspective view. The sloping portion 106 of each segmented portion of the rotor and stator 102,104 is shown to have its surface overlaid with tungsten carbide or synthetic diamond chips 112,114. The size of the chips decreases as the distance from the center of the grinding chamber increases. For example, the larger chips 116 positioned around the center portion of the chamber may range in size from 2 to 4 grit. The next section of medium chips 118 may range between 6–8 grit while the outermost fine chips 120 in the planar or outer perimeter portion may vary in size between 20–1000 grit. The hardness of these materials ranges from 89–94 Rockwell A for Tungsten carbide and 2400–2600 Knoop for diamond chips. The major drawback with this approach lies with the coarse tungsten carbide chips which may be liberated from their matrix during operation of the grinder. When chips are liberated, they must be reduced and pass through the fine grinding section in order to exit from the grinder. This causes undue wear on the stator and rotor segments 102, 104.

Figure 17:
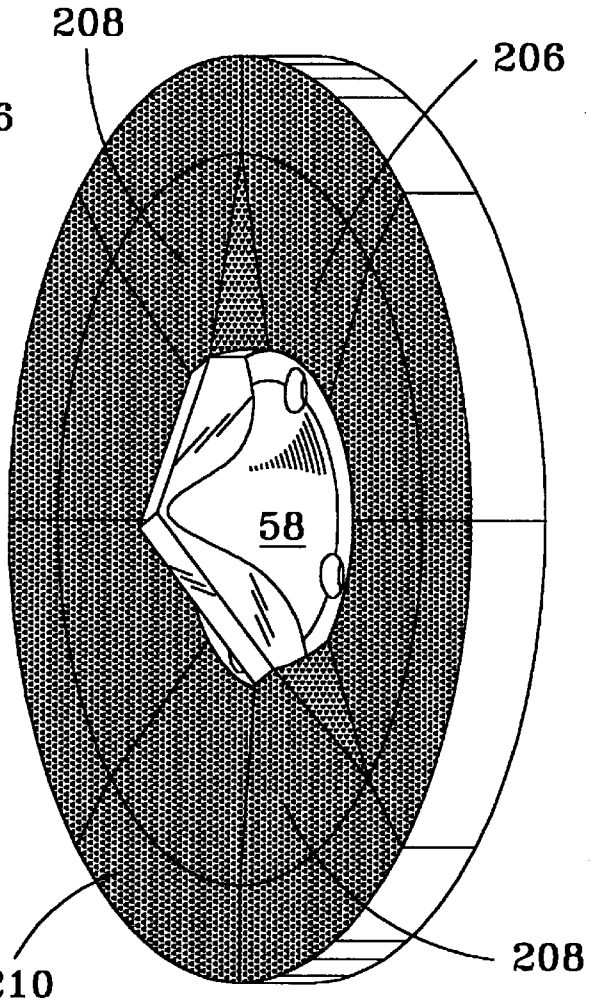
FIG. 17 is an isometric view of the third embodiment of the segmented non-intermeshing rotor illustrated in cross-section in FIG. 15.
Figure 16:
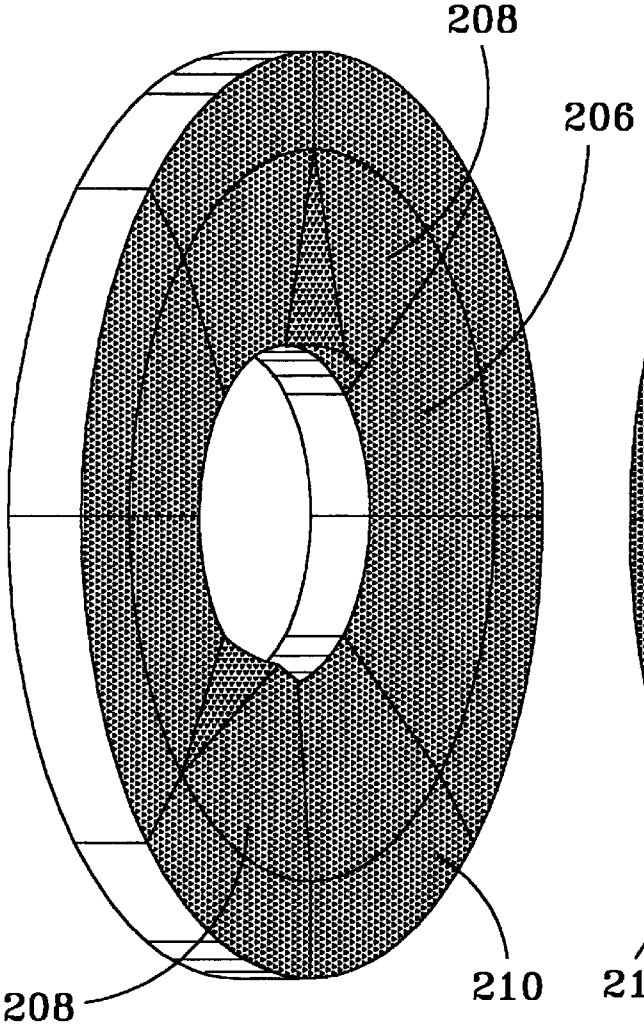
FIG. 16 is an isometric view of the third embodiment of the segmented non-intermeshing stator illustrated in cross-section in FIG. 15.

An alternate means of configuring the non-intermeshing stator-rotor assembly is shown in FIG. 15. This view shows the cross section of the stator and rotor assembly 200 wherein each is overlaid with finely ground tungsten carbide or synthetic diamond chip matrix in the range of 80 to 100 mesh. In this case, grinding and crushing means is provided by the shape of the stator and rotor segments 202,204 themselves. Each stator and rotor assembly 202,204 has one or more segments which form a "rise" or "hill" in the conical grinding chamber 206 as seen in FIGS. 16 and 17. When at least two segments without a sloping portion 208 of the rotor aligns with the corresponding non sloping portion 208 segments of the stator, a close clearance results so that any material trapped between the two "non-sloping segments" gets crushed. It is not necessary that the "non-sloping faces" be parallel to one another and a preferred configuration would feature a tapered interface (or gap) between at least a portion of the rotor and stator faces so that material would be progressively sized as it traveled further from the center of the grinder.

Figure 18:
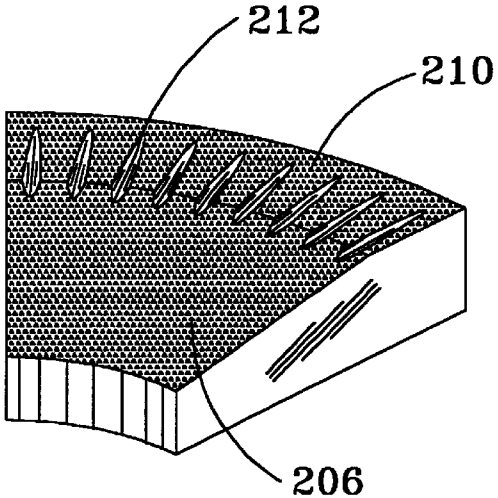
FIG. 18 is a partial isometric view of a fourth embodiment of the segmented non-intermeshing rotor and stator illustrated in FIG. 16 and 17.

FIGS. 16 and 17 better illustrate the actual construction of this alternate configuration. In these views, the stator and rotor are both equipped with two high points 208 which come in close proximity to high points on the opposing segment. The conically shaped chamber on the interior of the stator and rotor provides space for larger particles to enter into the chamber before being crushed. The fine grinding perimeter 210 of the segments may be additionally slotted 212 as shown in FIG. 18 to increase the throughput of the machine. The major advantage of this alternate approach is to minimize the particle size of tungsten carbide or synthetic diamond that must pass through the chamber in the event that it is liberated from its substrate matrix during operation. Also, experience has shown that the substrate matrix wear rate is much reduced when using 80 to 100 mesh or grit chips compared to coarsermesh or grit chips because less of the matrix is exposed to erosion and wear.

Figure 20:
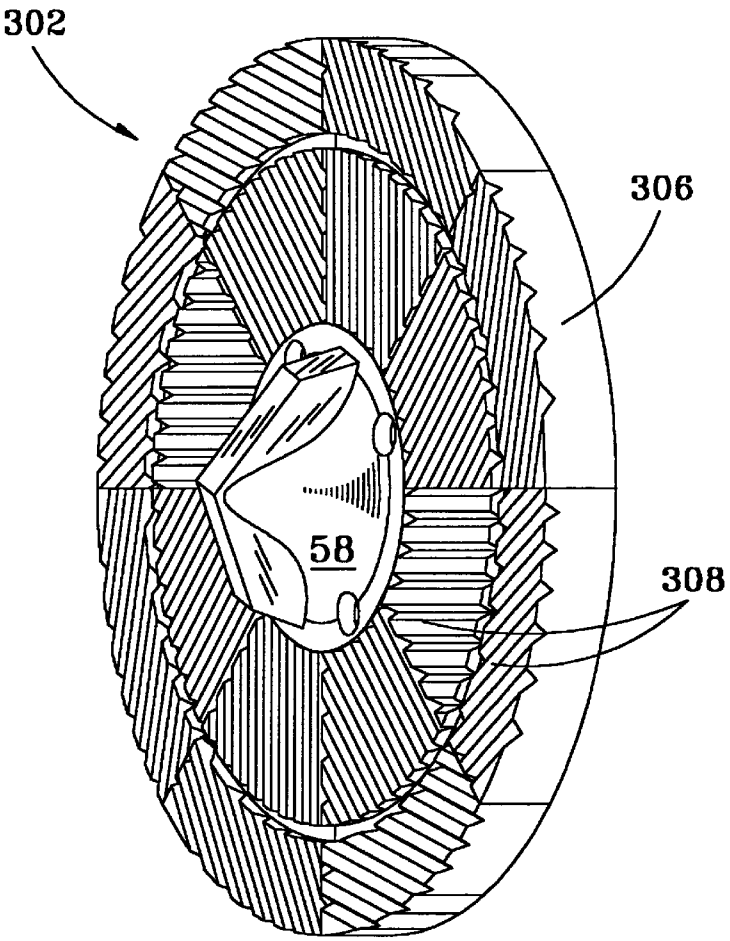
FIG. 20 is an isometric view of a fifth embodiment of the segmented non-intermeshing rotor.
Figure 19:
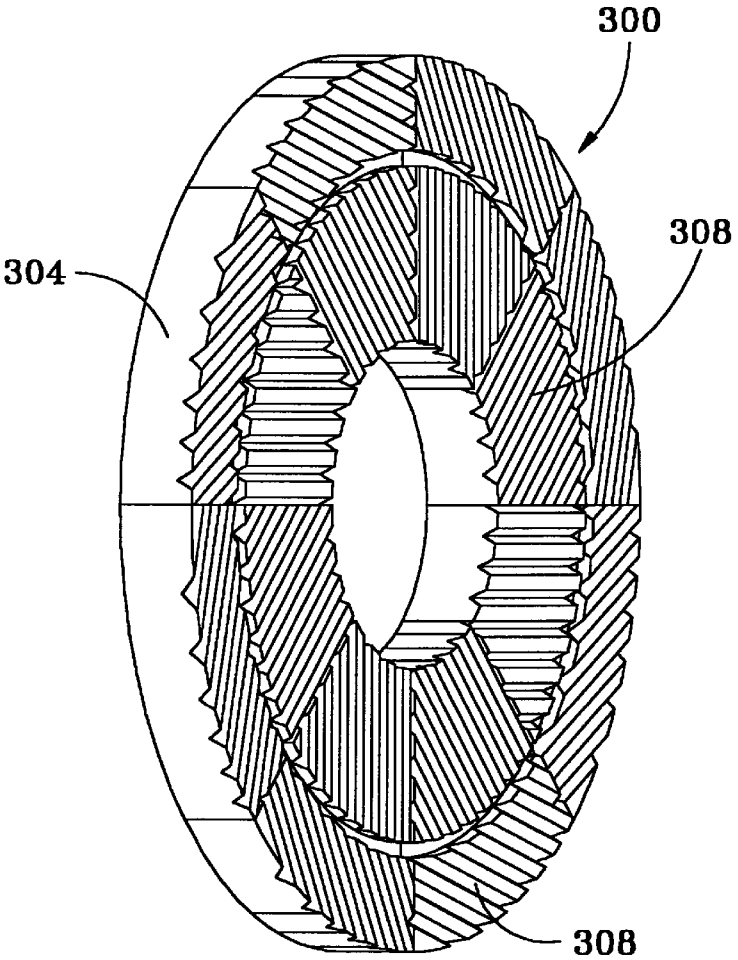
FIG. 19 is an isometric view of a fifth embodiment of the segmented non-intermeshing stator.

Another interchangeable non-intermeshing rotor-stator assembly configuration suitable for refining fibrous materials is shown in FIGS. 19 and 20. This configuration features segmented stator 300 and rotor 302 having surfaces running parallel and in close proximity to one another. The face of both the stator and rotor segments 304, 306 has a series of parallel grooves 308 cut into the surface at obtuse angles to provide a multitude of channels in which a fibrous slurry may travel and be dispersed without causing undue breakage of the fiber length. Segments are typically made from hardened alloy steel. Such non-intermeshing segmented stator assemblies are typically mounted as seen in FIG. 9, where the stator plate 44 is secured to the cover plate 18 with bolts 19. The segments 304 of the stator assembly 300 are located on the face of the stator plate by dowels 41 and secured to the stator plate 44 with bolts 45. It should be noted that the fine grind ring 54 may be used with the stator assembly 300 and that the fine grind ring 54 may be segmented with such segments 51 located on the face of the stator plate by dowels 49 and secured to the stator plate 44 with bolts 53. A similar arrangement is seen in FIG. 23 for the rotor assembly 302, rotor plate 46.

Figures 29, 30:
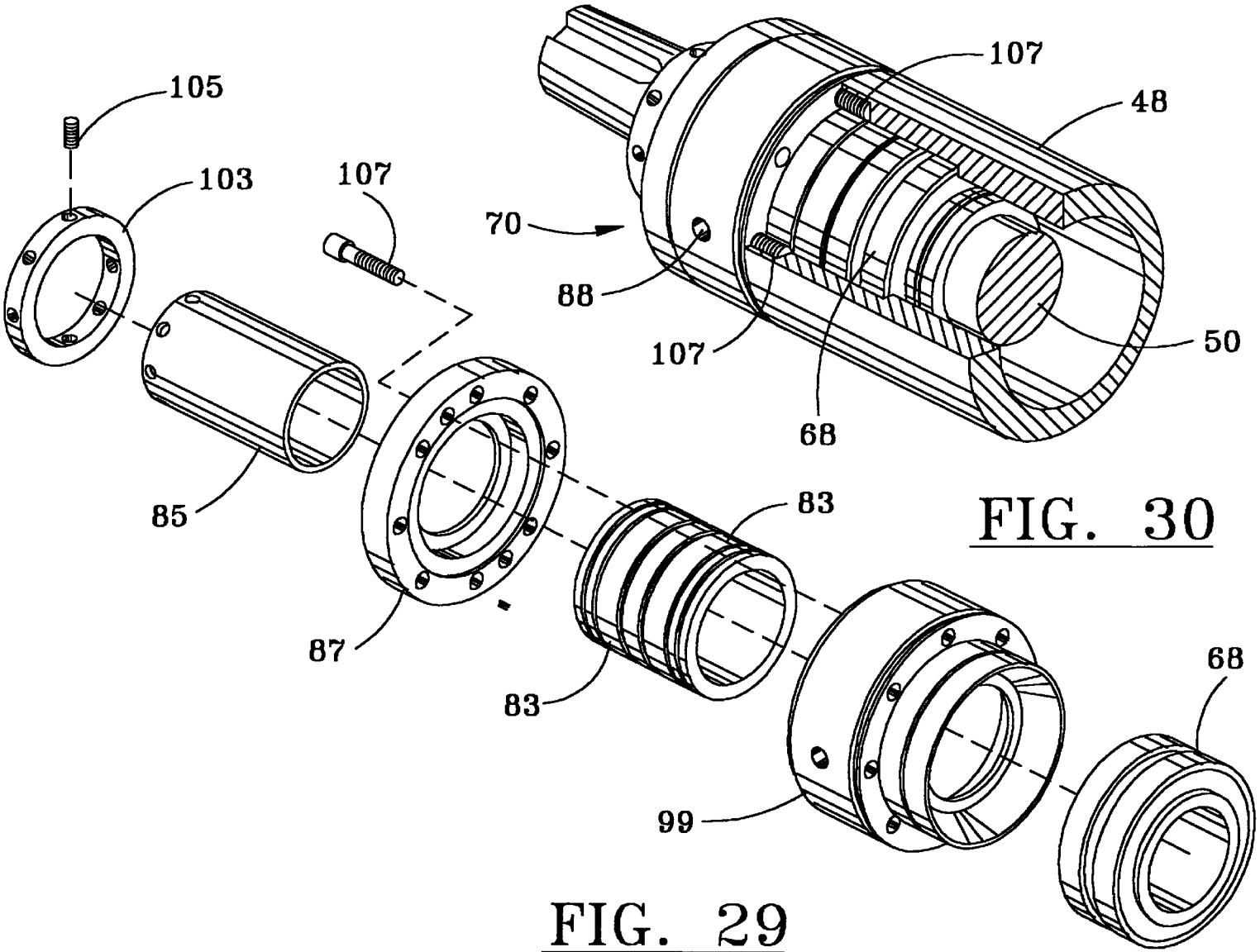
FIG. 29 is an exploded view of the mechanical seal and bearing assembly illustrated in FIG. 24.
FIG. 30 is a partial cut-a-way cross section isometric view of the mechanical seal and bearing assembly shown in FIG. 29 as assembled on the rotor shaft.

A more detailed view of the unique mechanical seal cartridge assembly 70 is provided in FIG. 29. We see the cartridge 70 is comprised of a double pair of mechanical seals 83 imposed on a shaft sleeve 85, both of which are retained within the cartridge housing 99 with a flange cover 87. It is also obvious that a single mechanical seal 83 could be arranged for use in some cases. The sleeve 85 is secured to the rotor shaft by the shaft collar 103 containing several set screws 105 which pass though the sleeve 85 and impinge the shaft 50. As seen in FIG. 30, the cartridge assembly 70 is attached to the end of the quill by bolts 107 passing though the flange cover 87 and cartridge housing 99. O-rings 77 positioned around the perimeter of the mechanical seal housing 99 and the quill 48 seal the quill assembly 47 in the longitudinal bore of the casing 12 so that process fluid circulating inside the grinding chamber 9 is prevented from leaking into the longitudinal bore of the casing 12. The seal housing 99 includes a beveled or lip portion 101 which projects into the longitudinal bore of the quill 48 and is sized to fit against the outer race of the shaft thrust bearing 68 without interference with the lock nut 57 and lock washer 59. With this configuration, the mechanical seal cartridge assembly 70 is used to clamp the thrust bearing 68 outer race against the shoulder 109 of the bearing cavity or pocket formed in the longitudinal bore of the quill 48, thereby forcing the shaft 50 and entire quill assembly 47 to move as a single unit. As seen in FIG. 30, using a mechanical seal assembly 70 to secure a portion of the thrust bearing 68 into its cavity within the slidable quill 48 results in minimizing the distance between the thrust bearing 68 and the rotor end of the shaft 50, thereby reducing shaft flexure and run-out. This configuration also improves the longevity of the mechanical seal and thus insures stator-rotor assembly alignment, which is essential with variable displacement stator/rotor assemblies.

As stated above, the mechanical seal 70 may be provided with a single or a double pair of mechanical seals. It is also possible to provide packing inside the seal cartridge 70 as a means of sealing the shaft in lieu of mechanical seals. However, the preferred embodiment of the seal cartridge 70 includes the use of double mechanical seals 83 subjected to a barrier fluid circulated into and out of the seal cavity through a pair of ports 88 indicated in FIG. 30. The barrier fluid is typically delivered at a pressure of 15 to 20 PSI above the process pressure inside the grinding chamber 9 as a means of insuring that the faces of the mechanical seals 83 are always lubricated and cooled by the barrier fluid. Process fluid would enter between the mechanical seal faces if the barrier fluid were not pressurized. Circulation of the barrier fluid through the seal 83 further provides an opportunity to continuously remove heat from the seal while simultaneously lubricating the seal faces. A single pair mechanical seal would not require the use of a barrier fluid, however, packing would perform best when continuously flushed and cooled with an external fluid source. However, the barrier fluid may tend to leak into the process fluid.

Having fully described the many options for configuring the in-line grinder, it has been found that this type of apparatus is directly applicable to the reduction of drill cuttings for injection into a wellbore formation. As a matter of background, a wellbore is formed in a generally conventional manner by providing a wellhead for supporting a casing string which extends within the wellbore. A drive pipe extends into the formation in support of the wellhead. Cement occupies the annular space between the drive pipe and the casing as well as an annular area between the formation and the casing. A secondary casing or protection pipe extends from the wellhead into the formation and is cemented at a zone which has been packed with cement and which leaves an annular area or space between the cement and the casing which is delimited by the formation and the protection pipe. A drill stem typically extends through the wellhead, the casing and the protection pipe to an open hole bottom portion of the well-bore. In accordance with conventional drilling practice, drilling fluid is circulated from a source down through the drill stem and up through the annular area formed between the drill stem and the pipe to a return receptacle or bell nipple. The drilling fluid returning through the annulus carries with it the earth particles or drill cuttings which, upon return to the surface, are conducted by way of a conduit to a separating device commonly known as a shale shaker. Drill cuttings which are too large to be included in the drilling fluid for recirculation into the wellbore are separated by the shale shaker and conducted by suitable conduit means to a unique system for treating and disposing of the drill cuttings in accordance with the present invention. Drilling fluid and finer drill cuttings particles not separated by the shale shaker are collected in a mud tank and processed in accordance with conventional practices before reinjection of the drilling fluid down through the drill stem. Smaller drill cuttings not separated by the shale shaker may be separated in conventional desanders and added to a slurry to be described herein.

Figure 21:
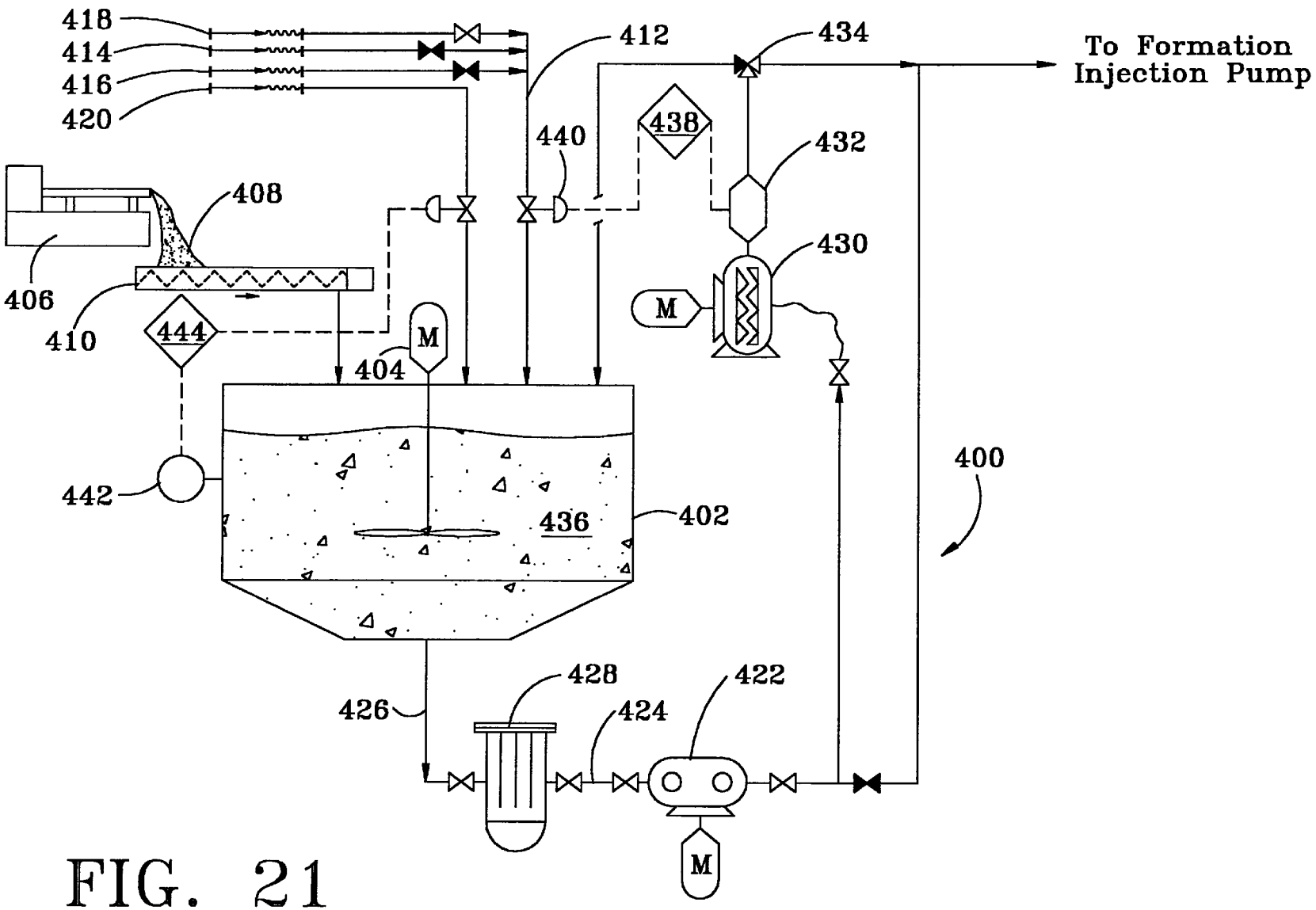
FIG. 21 is a schematic diagram illustrating a process utilizing the preferred grinder embodiment for processing drill cuttings.

In accordance with the present invention, a unique system is provided for processing the separated drill cuttings into a homogenous mix prior to injection into the earth formation. FIG. 21 illustrates a configuration of the system 400 in schematic form. The system 400 includes a receiving or slurry tank 402 which is fitted with a suitable agitation device 404. The slurry tank 402 is in fluid communication with a shale shaker 406, usually located on the drilling platform producing the drill cuttings 408, by way of a conveyor 410 for receiving drill cuttings 408 from the shale shaker 406. The slurry tank 402 is also in fluid communication with a conduit 412 which is connected to a source of slurry carrier liquid, which may be sea water 414, fresh water 416, or waste water 418 from the platform's sewage treatment system. A separate viscosity enhancing polymer line 420 is also routed to the slurry tank 402. The system 400 also includes one or more transfer pumps 422 which are in fluid communication with the slurry tank 402 by way of suction lines 424, 426. Positioned between the slurry tank 402 and transfer pump(s) 422 is a means of removing tramp metal and other unprocessable items, such as a magnetic trap 428. The transfer pump(s) 422 delivers the drill cuttings slurry 408 to one or more properly configured in-line grinder(s) 430 discussed herein for sizing the solids prior injection into the formation using a high pressure pump (usually a positive displacement pump). Valves 434 are provided for directing the sized cuttings either directly to the injection pump or back into the slurry tank 402. This option allows the system to be operated in a continuous fashion, in a batch mode, or a hybrid mode. In the continuous mode, drill cuttings 408 are continuously received, sized, conditioned, and delivered to the injection pump. In the batch mode, drill cuttings are received on an intermittent basis and recirculated through the in-line grinder until a tank size quantity of material is properly sized and conditioned. Afterwards, it is directed to the injection pump. Finally, the hybrid mode involves the continuous receipt of drill cuttings 408 and the recirculation of those drill cuttings through the in-line grinder 430 and back into the slurry tank 402. A side stream is continuously extracted from the discharge of the in-line grinder 430 and it is routed to the injection pump.

The sized solids leaving the in-line grinder 430 are suitable for routing through a mass flow meter 432 for the purpose of generating a signal proportional to the density of the slurry 436. This signal is input into a process controller 438 which modulates the flow of water into the slurry tank through a control valve 440 installed on the water input line 412 to the tank 402. This control loop provides a continuous means of delivering a constant density slurry to the formation. Further, the slurry tank 402 is equipped with a viscosity transmitter 442 which produces a signal proportional to the viscosity of the slurry 436. This signal is input into a process controller 444 which modulates the flow of viscosity enhancing polymer 420 into the slurry tank 402. The net result of the viscosity and density control systems is to deliver a sized slurry to the formation which has consistent and ideal properties for effective migration throughout the formation without plugging it. An optional means of introducing dilution water and viscosity enhancing polymers to the drill cuttings is by injecting them into the suction line of the in-line grinder 430 via control valve 446. The in-line grinder 430 has the ability to instantaneously disperse and grind the slurry so that quick adjustments can be made automatically to vary the slurry properties.

Figure 22:
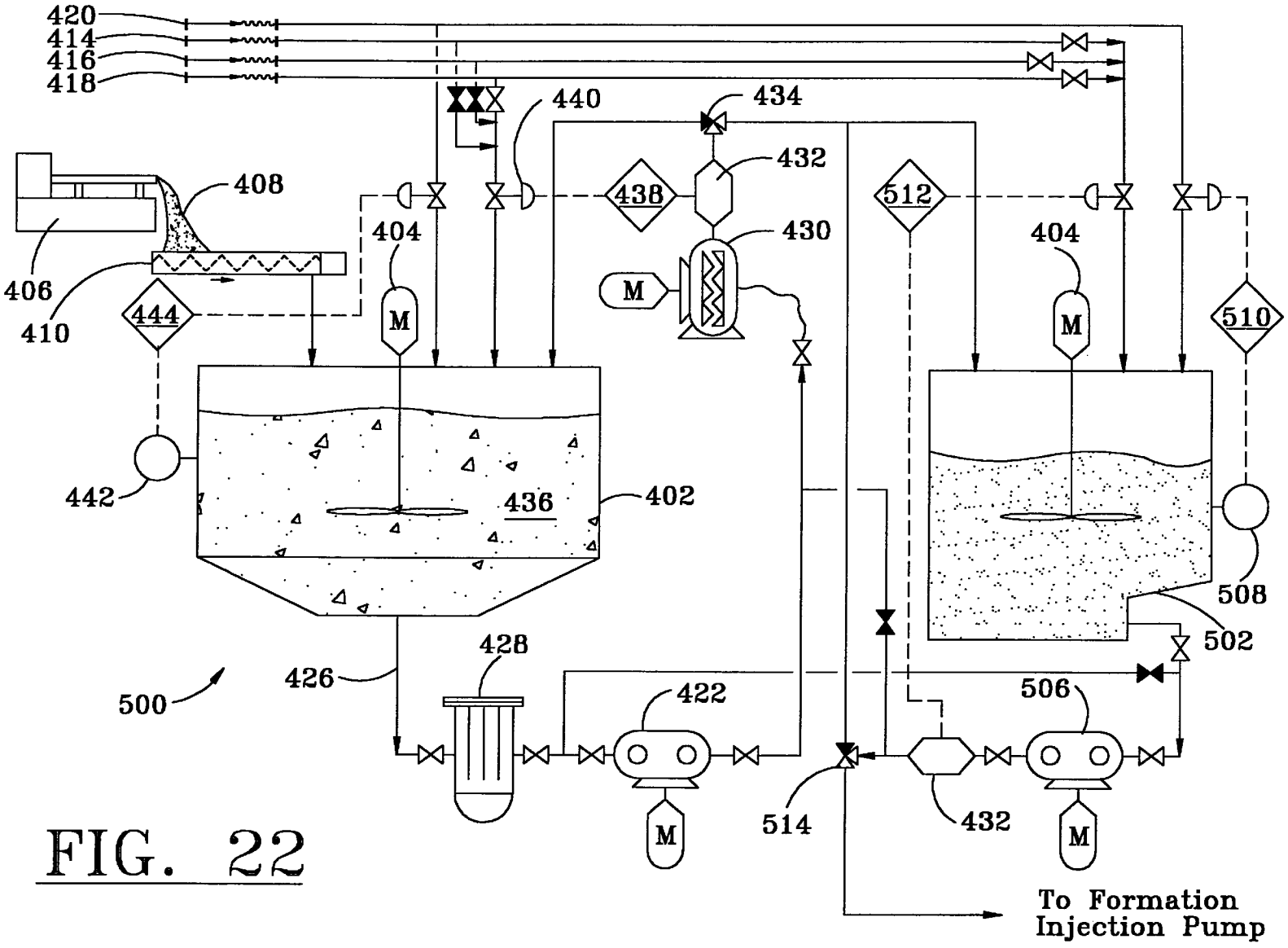
FIG. 22 is a schematic diagram illustrating a second process utilizing the preferred grinder embodiment for processing drill cuttings.

FIG. 22 illustrates the preferred embodiment of the drill cuttings processing system. It features a slurry system 500 comprising a slurry tank 402, transfer pump(s) 422,506, in-line grinder(s) 430, piping and instrumentation as outlined above. The system additionally comprises an injection system which receives the sized and conditioned drill cuttings from the slurry system. The injection system comprises an agitated injection tank 502, as well as one or more transfer pumps 506, piping, and instrumentation. The transfer pump 506 takes processed cuttings slurry 504 from the injection tank 502 and directs it to the injection pump; recirculates it back to the injection tank 502; directs it to the suction side of the in-line grinder(s) 430; or directs it to the slurry tank 402. Also piping interconnections are provided between the slurry tank transfer pump(s) 422, and the injection tank transfer pump(s) 506 so that each may operate from either tank, thereby increasing the versatility of the system. The injection tank 502 is also equipped with a fine viscosity transmitter 508 which delivers its signal to a fine viscosity controller 510. The viscosity controller 510 modulates the flow of viscosity enhancing polymers 420 into the injection tank 502. In like manner, the injection tank transfer pump 506 routes its flow through a second mass flow meter 432 for the purpose of generating a signal proportional to the density of the cuttings slurry 504. A fine density controller 512 receives the signal from the mass flow meter 432 and modulates the flow of dilution water 414–118 into the injection tank 502.

In normal operation, drill cuttings 408 are continuously sized and conditioned by the slurry system 500 and held in the injection tank 502 for injection. The density and viscosity adjustments made to the drill cuttings in slurry 436 is generally coarse in nature due to the variations in drill cuttings delivered to the system. The injection tank 502, being equipped identically as the slurry tank 402, has the ability to make fine adjustments to the properties of the drill cutting slurry 504 before injection into the formation by the injection pump. Therefore, the consistency and quality of the drill cuttings may be improved through the use of this automatic dual adjustment system 500. Flow control of cuttings to the formation may be regulated through variable speed control of the injection pump or through the use of a control valve 514 to bypass excess flow back to the injection tank.

The method and system of the present invention described herein above provides a simplified way of disposing of earth drill cuttings heretofore unappreciated within the art. Although a preferred embodiment of a method and a system structure, provided in a accordance with the present invention have been described herein above, those skilled within the art will recognize that various substations and modifications may be made to the specific embodiments described without departing from the scope and spirit of the invention as recited in the appended claims.

What is claimed is:

1. An in-line rotary disk grinder comprising:

a) a casing having an interior central longitudinal bore, a grinding chamber therein and a support base for said grinding chamber including a discharge port;

b) a cover plate attached to said casing covering said grinding chamber having an interior face and a suction port;

c) a stator assembly attached to said interior face;

d) a rotor assembly located in rotatable, parallel close proximity to said stator assembly;

e) a quill slidable within said central longitudinal bore;

f) a rotor shaft attached to said rotor assembly, located within and rotatable relative to said quill;

g) an input shaft assembly rotatable relative to said casing said shaft being cooperative with said rotor shaft; and h) a means for slidably positioning said quill.

2. An in-line rotary disk grinder according to claim 1 wherein said grinder further comprises at least one breaker bar located within said suction port.

3. An in-line rotary disk grinder according to claim 2 wherein said rotor assembly further comprises a rotor hub having flights cooperative with said breaker bar.

4. An in-line rotary disk grinder according to claim 1 wherein said grinder further comprises a fine grind ring attached to said stator assembly surrounding the periphery of said stator and rotary assemblies.

5. An in line rotary disk grinder according to claim 4 wherein said fine grind ring comprises a plurality of pie shaped segments forming a ring when mounted to said stator plate assembly, each segment comprising a base portion and a raised perforated ring portion.

6. An in-line rotary disk grinder according to claim 1 wherein said rotor shaft is rotatably supported within said quill by a thrust bearing located intermediate said shaft and a bearing located at an end of said rotor shaft opposite said rotor assembly an inter-race portion of said thrust bearing being removably secured to said shaft.

7. An in-line rotary disk grinder according to claim 6 wherein said grinder further comprises a mechanical seal cartridge assembly, rotatable relative to said rotor shaft and slidable relative to said casing, located between said quill and said rotary assembly in a manner whereby a portion of said cartridge assembly is in contact with an outer race of said thrust bearing.

8. An in-line rotary disk grinder according to claim 7 wherein said cartridge seal comprises:

a) a sleeve member including a set collar attached to said rotor shaft;

b) at least one mechanical seal assembly rotatable relative to said sleeve member c) a housing encasing and retaining said mechanical seal assembly including a flange cover, rotatable relative to said sleeve member, said housing further including a lip portion and a plurality of external seals; and d) a means for securing said flange cover and said housing to said quill.

9. An in-line rotary disk grinder according to claim 1 wherein said grinder further comprises a pivotal support arm attached to said cover plate and casing.

10. An in-line rotary disk grinder according to claim 1 wherein said means for positioning said quill includes a quill arm attached to said quill in a manner whereby said quill arm extends through a slot in said casing.

11. An in-line rotary disk grinder according to claim 10 wherein said rotor and stator assemblies are interchangeable with non-intermeshing rotor and stator assemblies.

12. An in-line rotary disk grinder according to claim 11 wherein said non-intermeshing rotor and stator assemblies comprise:

a) a stator assembly comprising;

i) a stator plate having a central bore;

ii) a plurality of pie shaped stator segments forming a disk, attached to said stator plate peripherally around said central bore, each said stator segment having a sloping central portion and a planar peripheral portion;

a) a rotor assembly comprising:

i) a rotor plate having a central hub member including flights extending therefrom; and ii) a plurality of pie shaped rotor segments forming a disk, attached peripherally around said hub member, each said rotor segment having a sloping central portion and planar peripheral portion;

b) a coating of tungsten carbide chips having a progressively coarse to fine grit ranging from 2 to 8 grit size covering said central sloping portions of each said rotor and stator segments; and c) a coating of tungsten carbide chips having a progressively medium to fine grit ranging from 20 to 1000 grit size, covering said planar peripheral portions of each said rotor and stator segments.

13. An in-line rotary disk grinder according to claim 12 wherein said rotor and stator segments further comprise a plurality of pockets located contiguous said sloping central portion and said planar peripheral portions.

14. An in-line rotary disk grinder according to claim 12 wherein said fine coating of tungsten carbide chips is ground to a roughness height of 32–500 microns.

15. An in-line rotary disk grinder according to claim 12 wherein said sloping central portion and said planar portion of said segments are coated in a matrix of diamond chips and dust.

16. An in-line rotary disk grinder according to claim 12 wherein a least two of said segments do not have a sloping central portion.

17. An in-line rotary disk grinder according to claim 11 wherein said non-intermeshing rotor and stator segments comprise a first portion having parallel grooves at obtuse angles to a vertical and horizontal axis of the segment and a second portion having parallel grooves at obtuse angles to said first portion.

18. An in-line rotary disk grinder according to claim 10 wherein said means for positioning said quill is a hydraulic actuator acting on said quill arm and includes adjustable stop means for limiting travel of said quill arm.

19. An in-line rotary disk grinder according to claim 1 wherein said rotor and stator assemblies are intermeshing.

20. An in-line rotary disk grinder according to claim 19 wherein said intermeshing rotor and stator assemblies comprise:

a) a stator assembly having a central bore and a plurality of perforated rings arranged in progressively expanding rows extending outwardly from said central bore; and b) a rotor assembly including a central hub member having flights extending outwardly therefrom, a base portion and a plurality of teeth having all sides perpendicular to said base portion arranged in progressively expanding rows extending outwardly from said hub member, said teeth being cooperatively rotatable in close proximity with said perforated rings and said at least one row of teeth located on said stator assembly.

21. An in-line rotary disk grinder according to claim 20 wherein said intermeshing rotor and stator assemblies further comprise at least one row of teeth adjacent said central bore.

22. An in-line rotary disk grinder according to claim 1 wherein said input shaft assembly further comprises a splined portion, a keyed portion; a roller bearing secured to said shaft; a bearing housing encompassing said bearing, a flange plate having a seal inserted therein connected to said bearing housing.

23. An in-line rotary disk grinder according to claim 1 wherein said grinding chamber is lined with a replaceable wear ring.

* * * * *

UNITED STATES PATENT AND TRADEMARK OFFICE

CERTIFICATE OF CORRECTION

PATENT NO. : 5,971,307

DATED : Oct. 26, 1999

INVENTOR(S) : Ricky W. Davenport

It is certified that error appears in the above-identified patent and that said Letters Patent is hereby corrected as shown below:

Col. 1, line 5:

Under the subheading "FIELD OF THE INVENTION" please insert the following as the first sentence:

This application claims benefit of U.S. patent application, 08/802,848 filed February 19, 1997 which is a continuation of application 08/477,229 filed June 7, 1995 now abandoned which is a divisional of application 08/368386 filed December 30, 1994 now issued as patent no. 5,495,986 which is a continuation of application 060753 filed May 12, 1993 abandoned, under 35 U.S.C. 120.

Signed and Sealed this

Thirteenth Day of June, 2000

*Attest:*

Q. TODD DICKINSON

*Attesting Officer*

*Director of Patents and Trademarks*